US011471738B2

(12) United States Patent
Bennett

(10) Patent No.: US 11,471,738 B2
(45) Date of Patent: Oct. 18, 2022

(54) INDOOR-TRADITIONAL CRACK CLIMBING HOLD

(71) Applicant: Hilton Bennett, Richmond, VA (US)

(72) Inventor: Hilton Bennett, Richmond, VA (US)

( * ) Notice: Subject to any disclaimer, the term of this patent is extended or adjusted under 35 U.S.C. 154(b) by 122 days.

(21) Appl. No.: 16/994,966

(22) Filed: Aug. 17, 2020

(65) Prior Publication Data

US 2021/0129001 A1 May 6, 2021

Related U.S. Application Data

(60) Provisional application No. 62/929,741, filed on Nov. 1, 2019.

(51) Int. Cl.
*A63B 69/00* (2006.01)
*A63B 71/06* (2006.01)

(52) U.S. Cl.
CPC ..... *A63B 69/0048* (2013.01); *A63B 71/0622* (2013.01); *A63B 2071/0625* (2013.01); *A63B 2071/0655* (2013.01); *A63B 2071/0694* (2013.01); *A63B 2220/56* (2013.01); *A63B 2220/833* (2013.01); *A63B 2225/74* (2020.08)

(58) Field of Classification Search
USPC ..... 482/37
See application file for complete search history.

(56) References Cited

U.S. PATENT DOCUMENTS 5,732,954 A * 3/1998 Strickler ..... A63B 69/0048 482/37
5,944,634 A * 8/1999 Neves ..... A63B 69/0048 482/37
6,514,178 B2 * 2/2003 Vettori ..... A63B 69/0048 482/37
7,252,273 B2 * 8/2007 Lewellen ..... A47C 13/005 248/223.41
7,594,874 B2 * 9/2009 Meissner ..... A63B 69/0048 482/37

(Continued)

FOREIGN PATENT DOCUMENTS

EP 2865426 A1 * 4/2015 ..... F16B 21/04
FR 2596658 * 4/1986 ..... A63B 69/0048

(Continued)

*Primary Examiner* — Sundhara M Ganesan
*Assistant Examiner* — Shila Jalalzadeh Abyaneh
(74) *Attorney, Agent, or Firm* — WCF IP

(57) ABSTRACT

Crack climbing is being sought out by more indoor climbers, however the issue that has arisen is that indoor features are fixed; cannot be removed or changed, thus climbing the feature indoors quickly loses its value as a method of getting stronger, or improving one's ability to adapt to outdoor environments. Currently if one wishes to practice or train for Crack climbing, they take to easy natural rock routes outdoors or build training boards out of wood to simulate common hand placements under the duress of a climb. Provided herein is an indoor-traditional crack climbing hold (I-TCCH) simulating a variety of Crack climbing situations and providing a "Settable" gym "Crack" to the simulated outdoor environment crack and the opportunity for climbers who wish to learn how to climb crack to have a safe way to learn about making correct hand placement, while conditioning themselves to natural rock surfaces.

20 Claims, 51 Drawing Sheets

(56) References Cited

U.S. PATENT DOCUMENTS

| | | | | |
|---|---|---|---|---|
| 8,038,581 | B1 * | 10/2011 | Sudeith | A63B 71/06 482/37 |
| 8,157,713 | B1 * | 4/2012 | Siskowic | A63B 21/0004 482/141 |
| 9,022,910 | B1 * | 5/2015 | Yehl | A63B 22/16 482/37 |
| 9,302,138 | B2 * | 4/2016 | McCanney | A63B 21/4035 |
| 9,539,483 | B1 * | 1/2017 | Tsang | H01L 27/00 |
| 9,656,111 | B1 * | 5/2017 | Biddle | A63B 17/02 |
| 10,857,427 | B2 * | 12/2020 | King | A63B 69/0048 |
| 11,154,760 | B2 * | 10/2021 | Mealing | A63B 17/04 |
| 2006/0192066 | A1 * | 8/2006 | Mills | A63B 69/0048 248/314 |
| 2007/0164182 | A1 * | 7/2007 | MacKay | A63B 69/0048 248/300 |
| 2007/0240281 | A1 * | 10/2007 | Meissner | A63B 69/0048 16/108 |
| 2010/0004098 | A1 * | 1/2010 | Hensley | A63B 69/0048 482/37 |
| 2011/0319230 | A1 * | 12/2011 | Brendle | A63B 21/4013 482/37 |
| 2014/0323274 | A1 * | 10/2014 | Moy | A63B 69/0048 482/37 |
| 2015/0056590 | A1 * | 2/2015 | Brost | A63B 69/0048 248/231.91 |
| 2016/0326745 | A1 * | 11/2016 | Lechuga | F16L 59/182 |
| 2017/0296877 | A1 * | 10/2017 | Bennett | A63B 69/0048 |
| 2018/0126218 | A1 * | 5/2018 | Curry | A63B 21/0552 |
| 2018/0304135 | A1 * | 10/2018 | Alon | A63B 69/0048 |
| 2019/0247714 | A1 * | 8/2019 | Curry | A63B 21/068 |
| 2020/0094102 | A1 * | 3/2020 | McRann | A63B 21/169 |
| 2021/0178240 | A1 * | 6/2021 | Barr | A63B 69/0048 |

FOREIGN PATENT DOCUMENTS

| | | | | |
|---|---|---|---|---|
| FR | 2596658 | A1 * | 4/1986 | A63B 69/0048 |
| FR | 2596658 | A1 * | 10/1987 | A63B 69/0048 |
| FR | 2628978 | A1 * | 9/1989 | A63B 69/0048 |
| GB | 2584759 | A * | 12/2020 | A63B 69/0048 |
| JP | 2001303595 | A * | 10/2001 | A63B 69/0048 |
| WO | WO-2010132865 | A1 * | 11/2010 | A63B 69/0048 |
| WO | WO-2016159778 | A1 * | 10/2016 | A63B 69/0048 |

* cited by examiner

INDOOR-TRADITIONAL CRACK CLIMBING HOLD

CROSS-REFERENCE TO RELATED APPLICATIONS

This application claims priority to U.S. Provisional Application 62/929,741 filed Nov. 1, 2019, the complete contents of which is incorporated herein by reference.

FIELD OF THE INVENTION

The present invention is in the technical field of Indoor Rock Climbing. This invention relates to indoor climbing holds meant to simulate outdoor rock features. It particularly relates to the use of an external cover over a rock like body, and a form conforming body between the rock like body and the wall surface; with the sum of the bodies mounted to a new or existing structural frame, to simulate an outdoor crevice environment while maintaining a gym "feel".

BACKGROUND OF THE INVENTION

Rock Climbing is changing as climbing gyms become the norm. What was once only accessible in outdoor environments is now being simulated in gyms creating a dualistic culture of those who climb indoors to train for outdoor climbing and those who climb indoors to exercise or for the experience. As the sport of rock climbing progresses and indoor climbing training holds and devices are developed, the need has arisen for climbing holds which "blend" the gym environment with the natural environment to properly simulate the feel of outdoor climbing in addition to harder to create or simulate rock features.

One of those types of natural climbing features gyms attempt to recreate indoors is Crack Climbing. Crack Climbing is the art of climbing a crevice using specific hand and foot techniques that rely on the wedging, and stacking of one's hands and feet, and or positioning one's body in such a way that one can pull or stem one's body upwards.

Gyms currently use permanent features built into their climbing wall structures to simulate a crack environment, or they build secondary structures that are also fixed in place and usually made of wood. The shortcoming of this strategy is that the "Crack" features never change. Thus, becoming of less and less use to the training climber while remaining out of reach to the beginner climbers.

Indoor climbing gyms have made great progress in teaching other forms of climbing indoors to include: bouldering (Low Wall climbing up to 30 feet, no rope required), top-roping (the most common form of indoor climbing whereby a climber is tethered into a harness, which is attached to a rope, which is attached to the highest point of the climb, the opposite end of which is attached to a belayer on the ground who will become responsible for the safety of the climber and ensuring their ascent and descent is controlled by tensioning of the rope through an ATC, Smart Device, Gri-gri, or other form of belay device), sport climbing (whereby the climber is belayed in line with their belayer while the climber maintains placement of the rope through specific anchor points (bolt hangers) by clipping first a quick draw into the anchor point and then the rope into the quick draw), ice climbing (is equitable to the sport climbing only the rock is a mixture of rock and ice or only ice and the probability exists that the climber must either place their own anchor points, climb by axe and crampon, or top-rope).

Climbing gyms have not successfully transitioned to teaching Traditional Climbing which consists of using active or passive hardware like Cams, Tri-Cams, Nuts, Hexes, and clipping into them with quick-draws or slings. The climber then clips the rope into the quick-draw or sling and continue climbing while being belayed from a partner on the ground, and aid climbing (which consists of using set anchor points to allow for a rope ladder type of climb to transition between each anchor point).

The great barrier with bringing Traditional Climbing into a gym environment is the need for a feature that can withstand a substantial tensioning and impact force simultaneously, whilst not disfeaturing the surface of the climbing wall, nor endangering the life of the climber, belayer or other gym patrons.

The fixed Crack features currently in climbing gyms cannot be loaded with more than human body weight, and cannot be used for traditional gear placements like cams or nuts, and in most cases cannot even be used with "dry tooling" like wooden "training" ice axes. Creating a useable but very limited feature.

In comparing these forms of climbing their commonality is found in Setters; people who "set" or "create" climbing routes at the gym and rely on the versatility of climbing holds to create "new" and unique climbing routes for gym goers. With a fixed crack feature there is little setters can do to create outside of what will always be the same feature.

This results in a situation where setters; as they get better and therefore more creative, find themselves using permanent crack features less and less, or in cycling through parts of the Crack to create angled trajectories which may use a portion of the fixed crack feature but not all of it.

SUMMARY

Embodiments of the disclosure provide an indoor-traditional crack climbing hold (I-TCCH) which may be used to simulate a variety of crack climbing situations. In some embodiments, the hold comprises a housing having a cavity; and a body at least partially inserted into the cavity between opposing walls of the housing, wherein a surface of the body extending from the cavity has a natural stone shape.

The Indoor-Traditional Crack Climbing Hold creates a more flexible, "moveable" feature that creates a renewable and ever new training environment. The flexibility and modularization of the Indoor-Traditional Crack Climbing Hold makes it a preferred method of creating non-static/non-fixed crack simulation.

Setters will appreciate having a Climbing Hold like device that can by itself or in combination with its pair, create a crack or crevice like feature. Additionally, with the size of the device being as small as a climbing hold the ease of carrying the device and attaching it to a climbing wall or as large as the height of a climbing wall, the opportunity can further inspire a setter to move the crack to any available portion of the climbing wall to integrate it with the various shapes and outcroppings of the existing wall.

The Indoor-Traditional Crack Climbing Hold (hereinafter "I-TCCH") body can be of a single piece and fit directly over the stone material, to be screwed, bolted or fixated to the indoor climbing wall; and/or it can be of two pieces to encase the stone material from opposing directions, or of multiple pieces to encase the body from multiple directions, with the sum of the bodies ultimately pinned to the climbing wall.

The I-TCCH body can be used individually or in combination with an indefinite number of I-TCCH bodies to create a partial or continuous crack feature. A removable or fixed Interlocking feature allows them to be physically linked to one another to define a crack trajectory.

The I-TCCH can itself be used as a climbing hold while attached to the climbing wall; in addition to the crack feature it creates. While larger versions of the I-TCCH provide mounting locations upon the device for "Normal" climbing holds to be mounted. Ideally, The I-TCCH will be used in pairs so that minute changes in direction will create entirely new features. However, as an individual body it can contain one or more "stone" like bodies to create this "Crack" feature.

Together, one or more of the I-TCCH bodies can also be linked by proximity to create a continuous Crack feature, that is indefinitely long.

Additionally, due to the fact that this device could in its crack form be bolted to the wall the same as any normal climbing hold, a variation noted and claimed in this invention is that of bolting one or more of the I-TCCH Bodies into structural members of the climbing wall; namely locations where bolt hangers exist. A second, I-TCCH Body parallel to the first body would also need a structural member to be bolted into for the two members to be considered structural.

Additionally, given the rise of climbing competitions and the move for Bouldering, Top Roping and Speed Climbing to be events in the 2020 Olympics, there will foreseeably be the day when Indoor Traditional Crack Climbing sees it's day at similar competitions. This projection suggests that having a way for referees to know that a climber has reached a particular point would be to have that point "signal" that such has occurred. Thus, in some embodiments, the I-TCCH may house touch, vibration, frequency or other sensors, and auditory and visual alerts as a result of such sensor, such that when touched the I-TCCH Body will light up, give off an auditory alert, and or send that information to receiver to record the "point".

The outer casing of the I-TCCH body can be translucent and housing of a sensor or sensors that sense the pressure of one touching it to activate an interior light for competition purposes such that a climber during a competition, should they be able to reach and contact the hold are shown to have done so by visual confirmation of the light being activated.

The body can also house a reflective light and auditory buzzer to signal a climber reaching a critical point in the climb.

In some embodiments, the I-TCCH comprises two or more distinct but reliant upon one another pieces. The first being the Housing or Outer Body of the I-TCCH which houses the Stone like Body, which is compressed by the mechanical or physical feature of the Form-Fitting Body that sandwiches the Stone Body to the Housing or Outer Body due to the physical compression of the Outer Body to the Climbing Wall Structure by a Bolt/Screw or other means of structural attachment which by action increases the compression of the bodies.

The I-TCCH Housing and Stone Body can be used in combination with the Climbing Wall Structure due to the physical compression of the Housing/Outer Body sandwiching the Stone Body to the Climbing Wall Structure by a Bolt/Screw or other means of structural attachment which by action increases the compression of the bodies to the Climbing Wall thereby securing the sum of the bodies.

The multiple variations and combinations of said bodies are interchangeable depending on the material used for the manufacturing of the bodies. The materials for the various bodies can be plastic, nylon, fiberglass, metal, stone, composites or wood.

A variation of the I-TCCH Body accounts for this method of use by housing an internal body (Structural Plate) within the I-TCCH body that when inserted to the I-TCCH Body and then mounted to the Climbing Wall Surface in connection with the Sandwich Plate at the rear of the Climbing wall surface a Structure is formed of comparable strength to a Bolt Hanger mounted into the Frame of the Climbing Wall. Additionally, the sum of these interchangeable bodies in their interaction when combined with Interior Structural Plate, creates a more robust body and the ability to withstand greater impacts or shock loads due to a climber falling. With an ultimate purpose of creating a Traditional Climbing Crack Feature within which Traditional Climbing Gear may be placed.

An interior structural plate cavity is featured on the Housing Body to receive the Interior Structural Plate which when acted upon by the Bolt/Screw increases the structural integrity of the Housing Body and the Rigidity of the Stone Body under loading such that if bolted into the Frame of the Climbing Wall this body is considered to be structural.

Further, when the Interior Structural Plate is combined with the Housing Body, and the Sandwich Plate which goes behind or to the interior of the Climbing Wall Structure, the I-TCCH mounted anywhere on a climbing wall can become a structural member of the climbing wall structure.

To prevent the additional risks that come with Traditional Climbing Indoors, there is the modular attachment, with incremental positioning that allows for the position of the anchor to be rotated to any position around the Bolt holding the I-TCCH in place.

It stands to note that one skilled in the art of climbing or engineering will recognize that the surface shape of the stone can vary to create new and unique features, while the compressed shape of the stone can vary to be compressed in various configurations.

Similarly, the "Stone" likeness may be actual stone, wood, plastic or a variety of materials capable of simulating rock features or climbing structures.

The stone can completely fill the Housing Body or partially fill the Housing Body. The additional space in a partially filled Housing can be left empty or filled with another body to capture or remove the space.

Used individually two or more Stone Bodies can be fit into a single Housing Body with or without filling the Housing Body Cavity and still achieve the crack or crevice like feature that two bodies can otherwise create.

This single body can then be used as two separate bodies would be used for gear placements, as a natural hand/foot holds, as a natural anchor, etc.

When used in combination with Sandwich Plates or when bolted to the existing structural frame of the climbing wall, the I-TCCH pair can receive Traditional climbing gear and be loaded as in outdoor traditional climbing as a method of training for traditional climbing indoors.

Traditional Climbing Gear to include Cams, Nuts, Hexes, Tri-Cams, Wedges, Friends, Knots, Aid and other gear will all be able to find a home between this crevice/crack feature.

As an attachment an additional feature can be added to the I-TCCH to create a Traditional Anchor and or a Secondary Anchoring Point to act as the Primary Anchoring Point in a gym setting such that the Traditional Gear is not taking the initial load of a fall or such that the Traditional Gear is taking the initial load of a fall and the Anchoring point is acting as a backup to the Traditional Gear placement.

The shape and length the I-TCCH can vary to increase the climbable surface area, as well as the gear placement surface area. In many cases the device can be configured to receive other climbing holds so as not to manipulate too many t-nuts in the creation of a crack feature.

Additionally, as the shape lengthens, the stone inserts can be configured to be a single piece or multiple pieces resting upon one another or upon a surface or surfaces within the I-TCCH Body. To which point the I-TCCH Body in its various forms can as a shape change direction from that of a linear form to that of a zig-zag form, circular, or other form. What remains significant about the I-TCCH Body is its ability to capture a stone or stone like body and retain it against another surface or multiple surfaces, such that it is retained to the climbing wall surface as a climbing, crack, or traditional gear feature.

Similarly, the direction and number of Slotted Attachment Features on each I-TCCH Body can change from Vertical to Horizontal, Diagonal, or even to an "X" like shape in an effort to capture the available T-Nuts.

In its various forms the I-TCCH can be of a completely solid body at the rear or hollow in nature to reduce overall weight of the device while simultaneously creating a Suctioning feature The present invention is a device to be used individually or in combination with its pair, or with a plurality of similar devices and attachments to be attached to indoor climbing structures in such a way as to simulate an outdoor climbing environment while maintaining an indoor climbing look and feel.

BRIEF DESCRIPTION OF THE DRAWINGS

FIGS. 30, and 31 show the isometric of FIG. 29

FIGS. 35, 36, 37 and 38 show various views of FIG. 34 with the I-TCCH Body (100 & 125) "sandwiching" the Stone Body (200) to the Climbing Wall Structure (800); while indicating where Gear Placement (700) occurs between the bodies, in relation to the various positions the I-TCCH Bodies (100 & 125) can be adjusted to.

FIGS. 50 and 51 additionally show the Stone Cavity (103) that receives the Stone Body (200)

FIGS. 50 & 52 introduces the additional Rear Cavity (153) that can potentially create a suctioning feature, while showing a side view of the combined body cavities of FIGS. 45-51

DETAILED DESCRIPTION OF THE INVENTION

As described herein, the term "indoor rock crevice simulating hold" is used interchangeably with "Indoor-Traditional Crack Climbing Hold (I-TCCH)".

Figure 1:
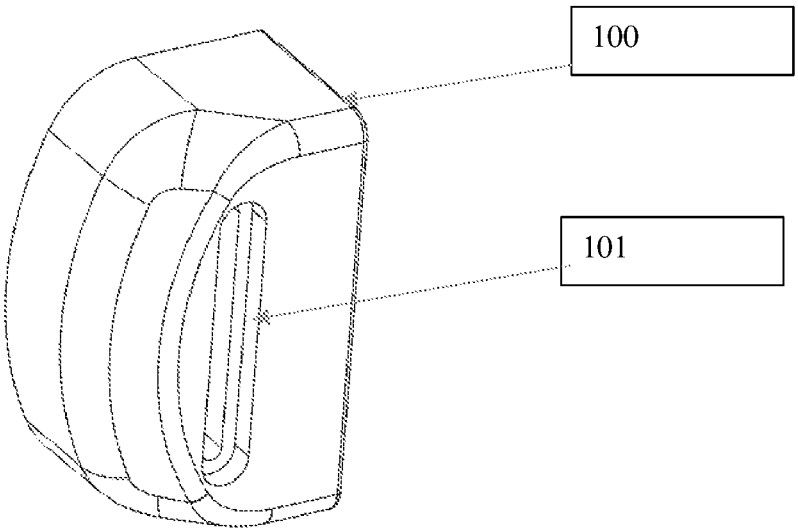
FIG. 1 is a perspective view of the I-TCCH Body (100) showing the Slot (101) for the Bolt (400) attachment.
Figure 2:
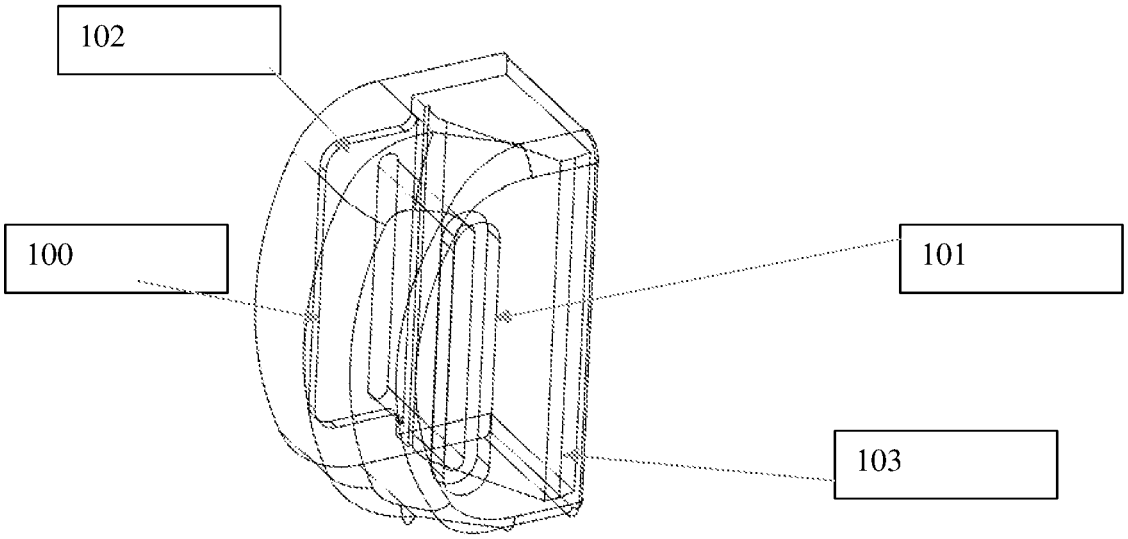
FIG. 2 is clear perspective view of the I-TCCH Body (100) FIG. 1 showing the Slot (101) going all the way through the Body (100), and the cutaway of the Tab 102 on the rear of the device and the Stone Cavity (103) for the Stone Body/s (200)

Referring now to embodiments of the invention in more detail, in FIG. 1 there is shown an The I-TCCH with the Slotted feature to receive a Bolt, and Washer, which will connect through the Climbing Wall Surface to join with a T-Nut or to a Structural Member of the Climbing Wall Structure.

Figure 3:
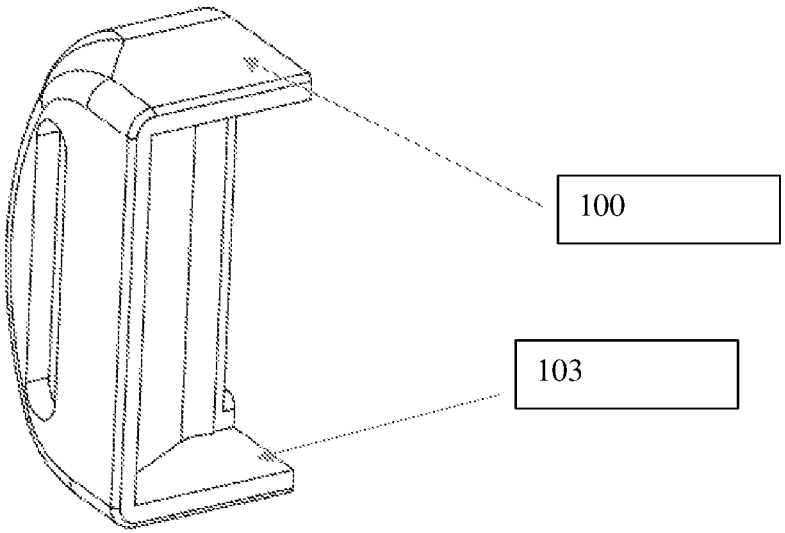
FIG. 3 shows the Stone Cavity (103) for the Stone (200), and the location for the Shape Conforming Body (300) in relation to the location for the Stone (200), and the I-TCCH Body (100), while itself being the sandwiched body between the sum of the I-TCCH bodies and the Climbing Wall Surface (800)
Figure 4:
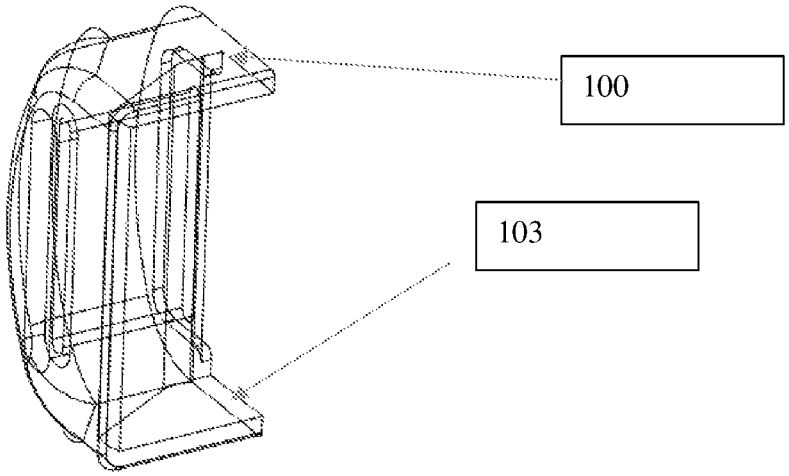
FIG. 4 is a clear view of the Stone Cavity (103) and shows the position for the Shape Conforming Body (300) which becomes sandwiched between the Stone Body (200) and the Climbing Wall Surface (800).
Figure 7:
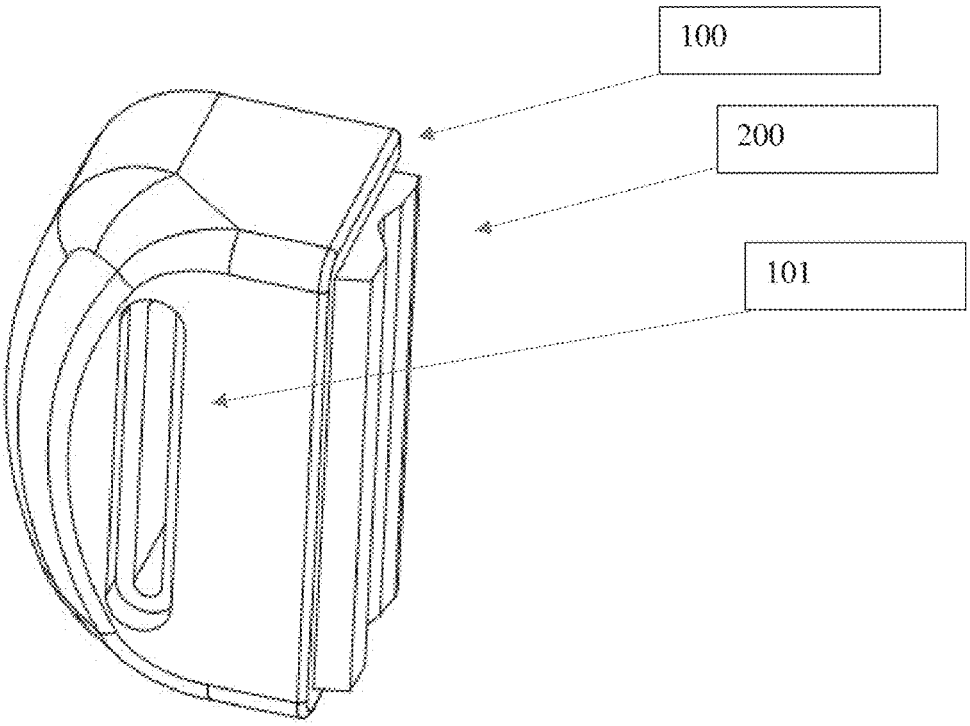
FIG. 7 shows the Stone (200) inside of the I-TCCH Body (100)
Figure 8:
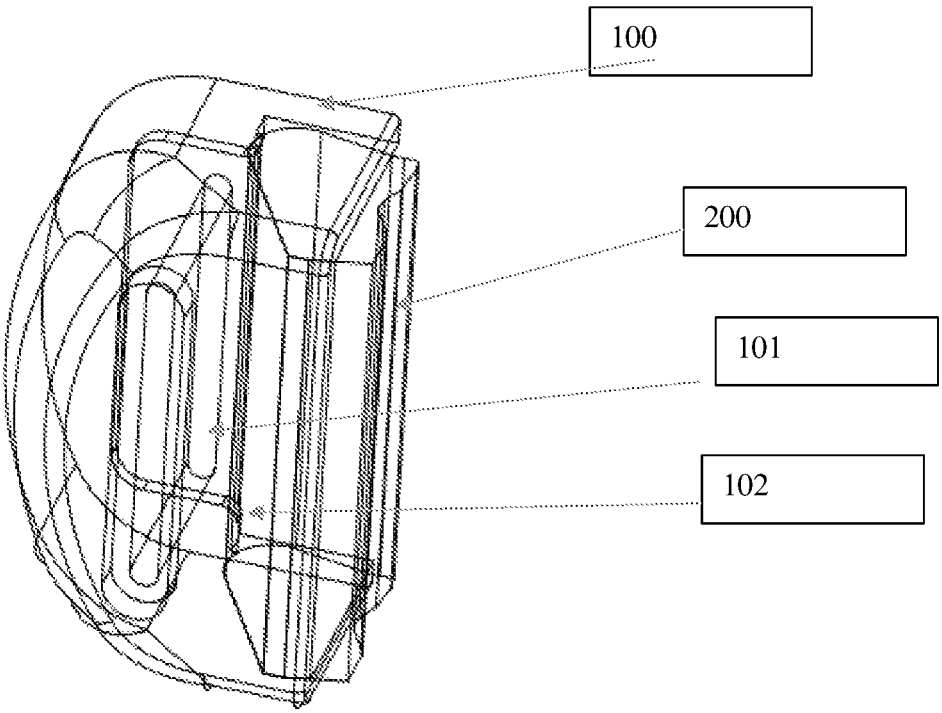
FIG. 8 is the clear view of FIG. 7 and shows the shape of the location for the Shape Conforming Body (300) in proximity to the Tab (102) and in shape relation to the fit of the Stone (200), and how the shape of the stoned prevents; upon pressure from the I-TCCH Body (100), any movement of the Stone (200) within the body due to corresponding pressure from the Climbing Wall Surface (800).
Figure 11:
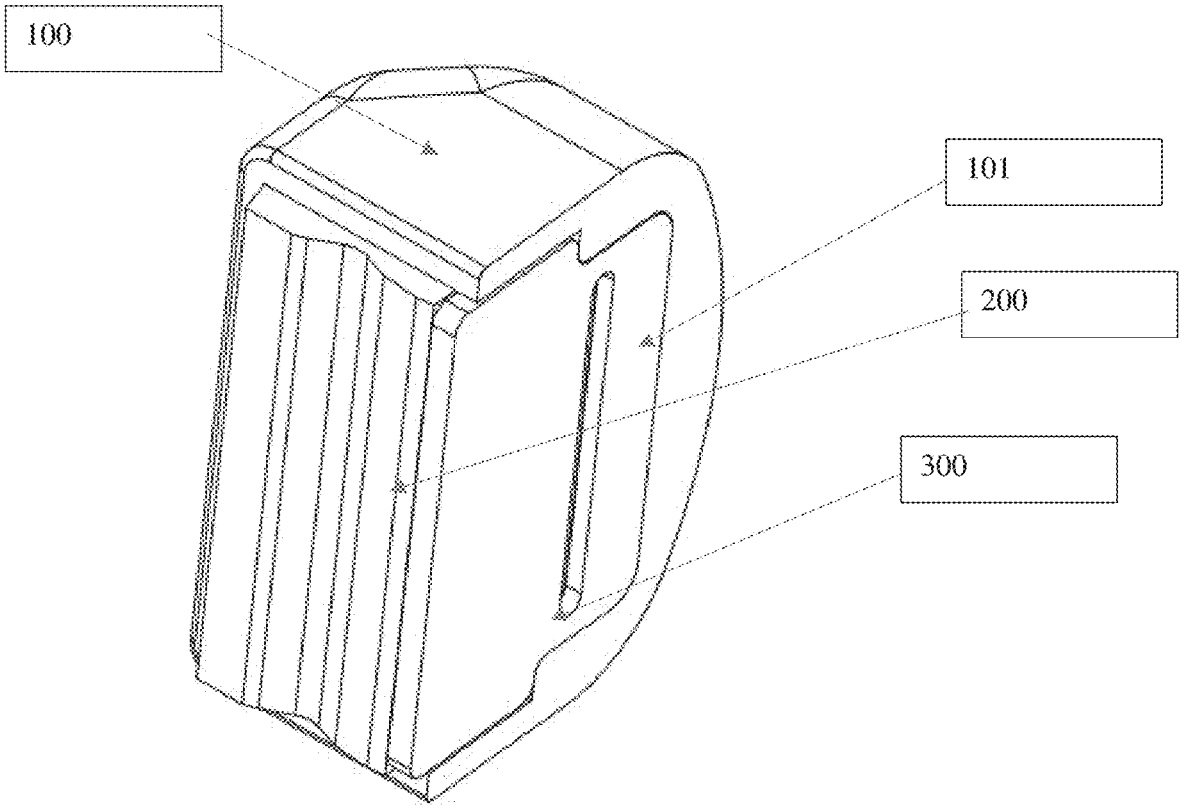
FIG. 11 shows the Shape Conforming Body (300) about the Stone Body (200) within the I-TCCH Body (100).
Figure 12:
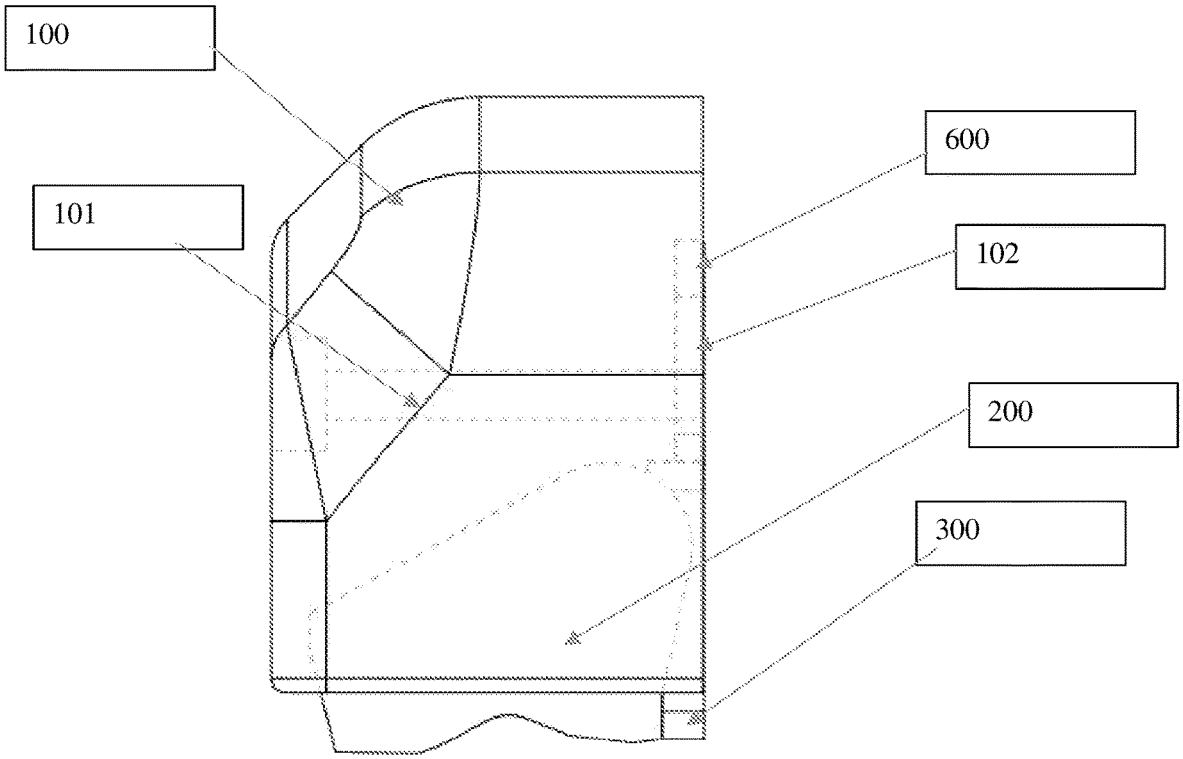
FIG. 12 expounds upon FIG. 11 showing the internal view to include the Shape Conforming Body (300) the Tab (102) for modular connections, and the Anchor (600) location which overlays the Tab position by being a part of the Shape Conforming body or by point of connection to the Bolt that exits the Body (100) to connect to the Climbing Wall (see also line 0057, and later FIG. 58).
Figure 13:
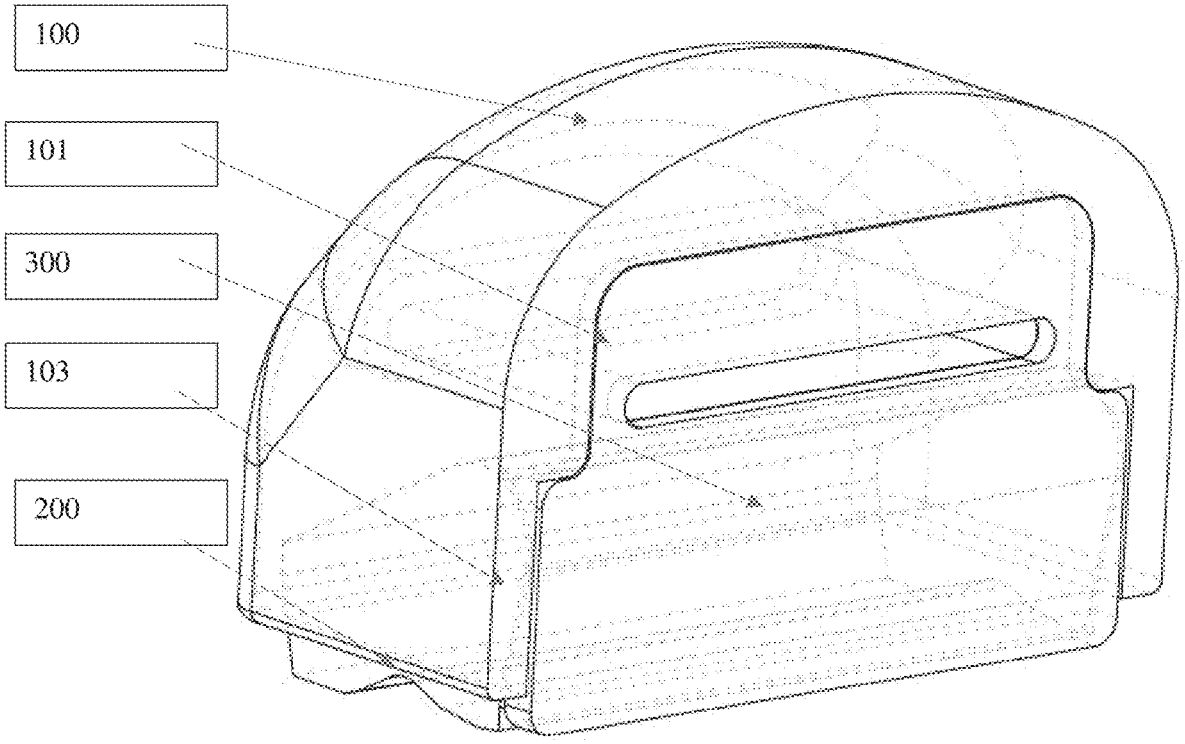
FIG. 13 expounds upon FIG. 12 showing the internal view.
Figure 14:
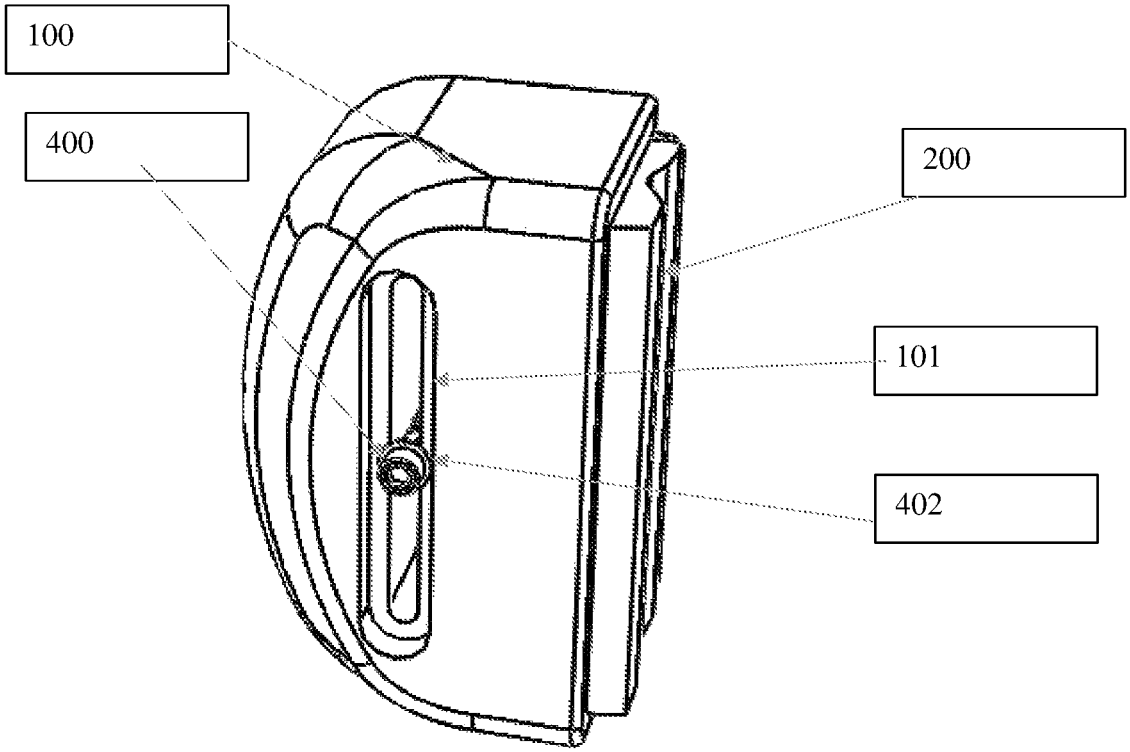
FIG. 14 shows the Bolt (400), Washer (402), within the I-TCCH Body's (100) Slot (101)

The I-TCCH can be topped by the Shape Conforming Body of FIG. 11, in the Tab of FIG. 3, after being filled with the Stone/s of FIG. 7, in the Stone Cavity of FIG. 3. The sum of these bodies makes up the first embodiment (100), and creates a flexible, "moveable" feature that offers a renewable, modular, non-static/non-fixed method of Crack Simulation on an Indoor Climbing Wall.

Figure 5:
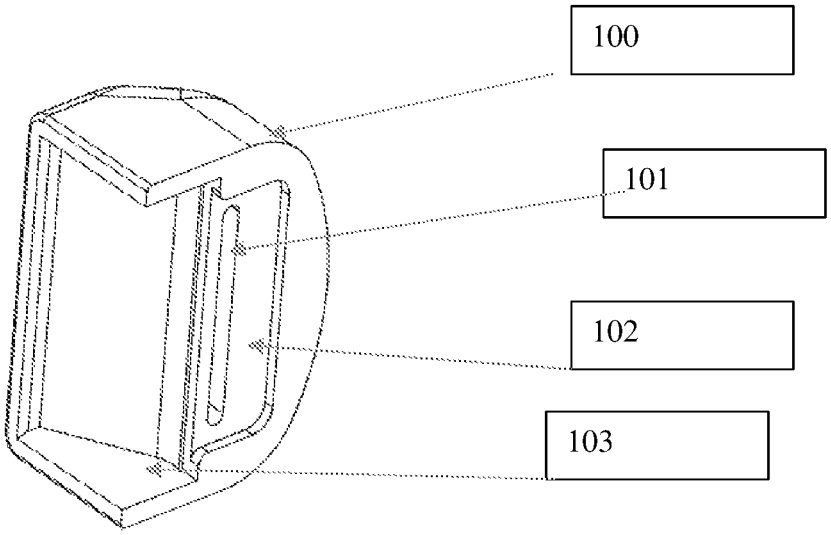
FIG. 5 expounds upon FIG. 4 and shows the Slot (101) going all the way through the I-TCCH Body (100), and the Tab (102). The location of the Stone Cavity (103) is also shown.
Figure 6:
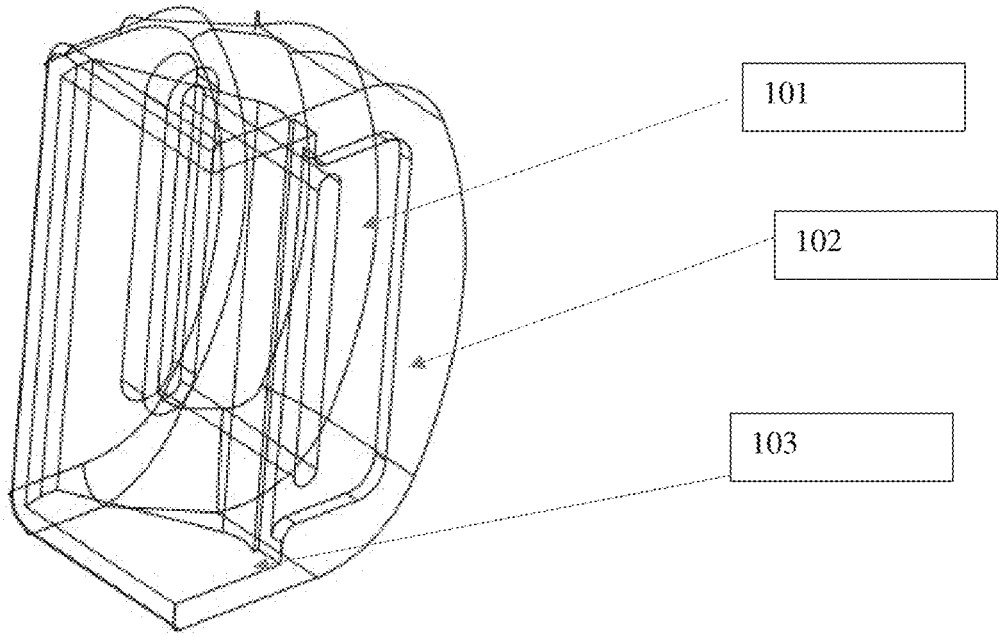
FIG. 6 is the clear view of FIG. 5

Due in part to the Slot feature of FIG. 5, the various embodiments of the I-TCCH (100, 125, 150) can be used individually or in combination with any of the other embodiments to create an ever-new crack or crevice like feature, simply by repositioning or adjusting the location of the I-TCCH body.

Likewise, the Stone of FIG. 7, being interchangeable, in shape, material, etc. creates a renewable training environment.

Figure 9:
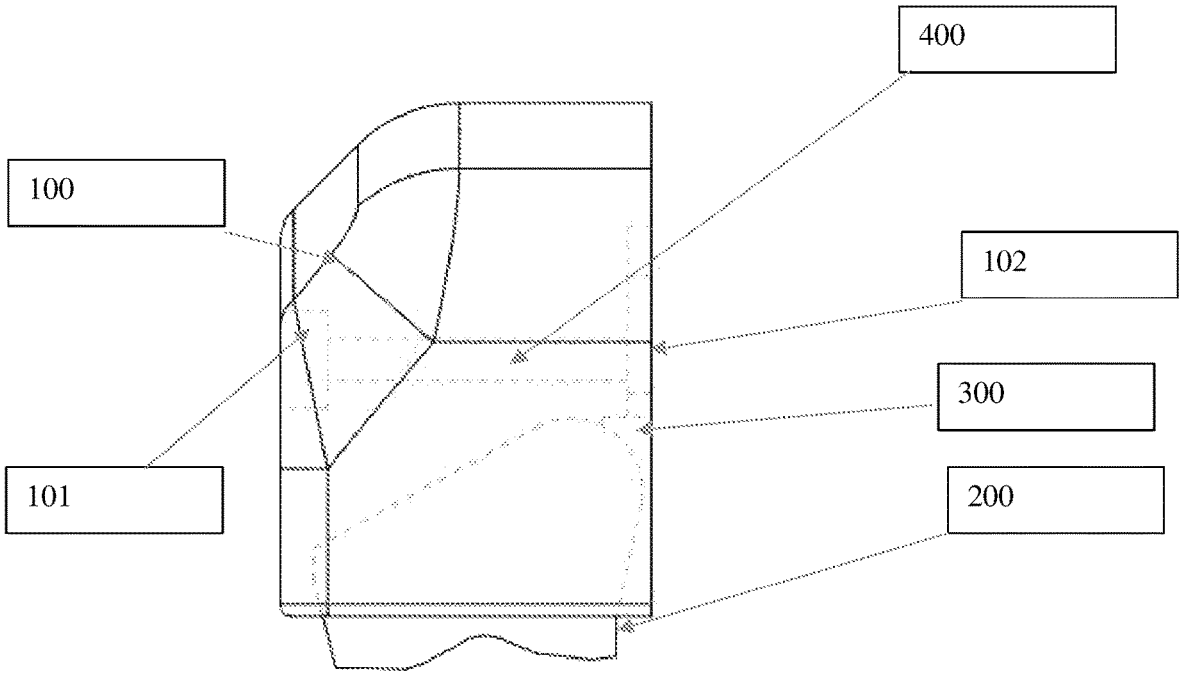
FIG. 9 is an internal view showing the Stone (200), Bolt (400), the Tab (102) for the fit of the Shape Conforming Body (300), and or the Anchoring Body (600), and Slot (101) inside of the Body (100).
Figure 10:
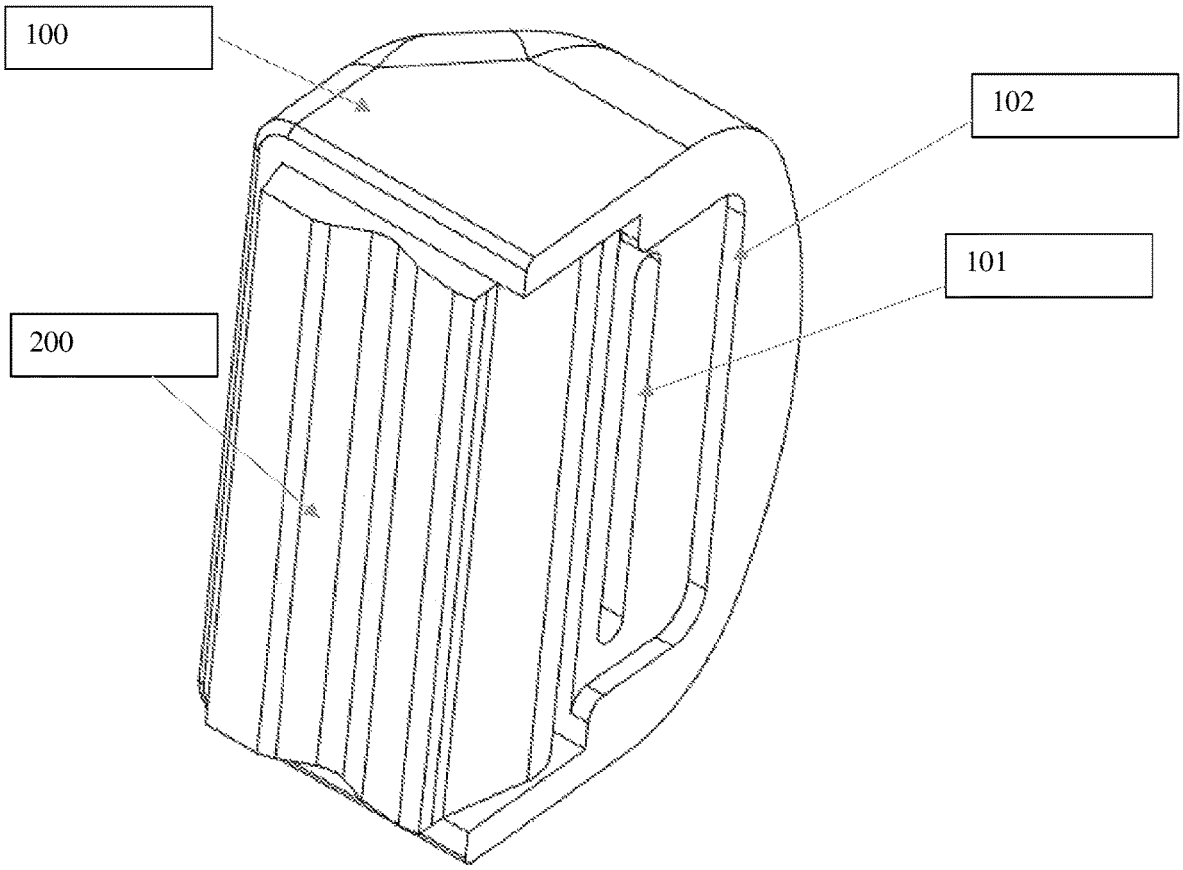
FIG. 10 expounds upon FIG. 9 by removing the Shape Conforming Body (300), to show the shape with which the Shape Conforming Body (300) conforms to the Stone (200), and to demonstrate how the Stone (200) depending on the material can be made to contact the Climbing Wall Surface (800) in the absence of the Shape Conforming Body (300) to form a complete sandwich.

FIG. 9 shows an internal view of this first embodiment (100), noting particularly the Bolt location, the Tab location for the Anchor, and the "fit" of the Shape Conforming Body to the Stone. FIG. 10 further expounds by showing the removal of the Shape Conforming Body, and thus the related shape of the Stone.

Figure 15:
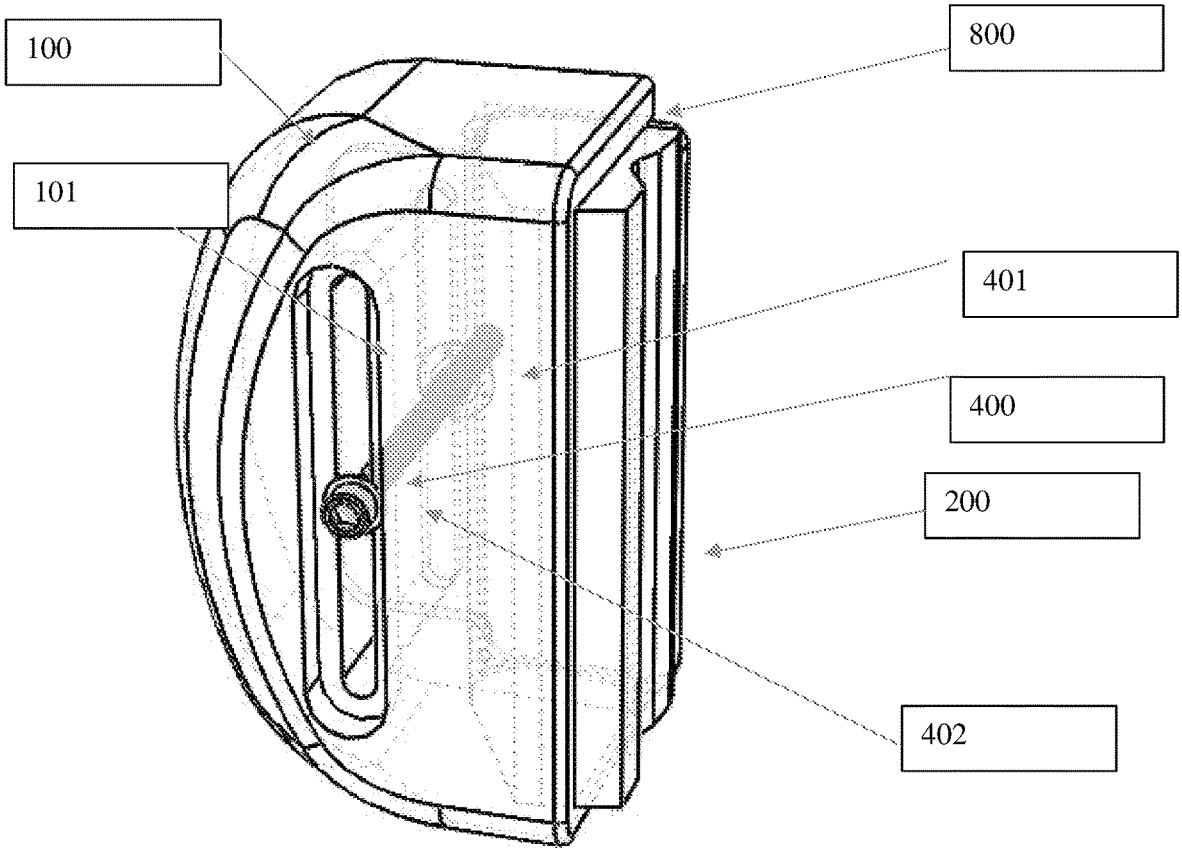
FIG. 15 expounds upon FIG. 14 showing also the T-Nut (401) attached to the Bolt (400) and Washer (402) between the Bolt (400) and the I-TCCH Body (100), and behind the Climbing Wall Surface (800).
Figure 16:
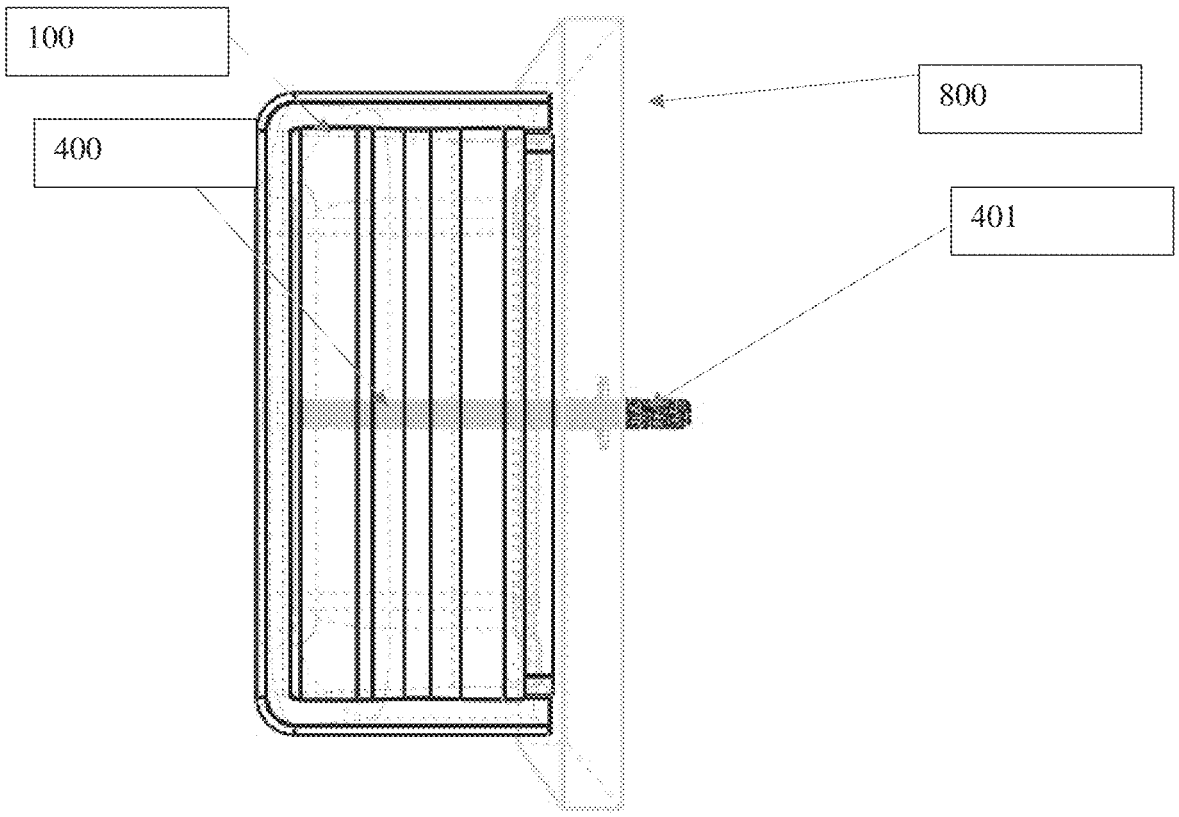
FIGS. 16, 17, and 18 are views of FIG. 15 showing also the Climbing Wall Structure (800) in relation to the T-Nut (401) which to note is also the interchangeable location for the Structural Plate Connection that would otherwise be a Structural Member of the Climbing Wall through which there is an Anchoring Location.
Figure 17:
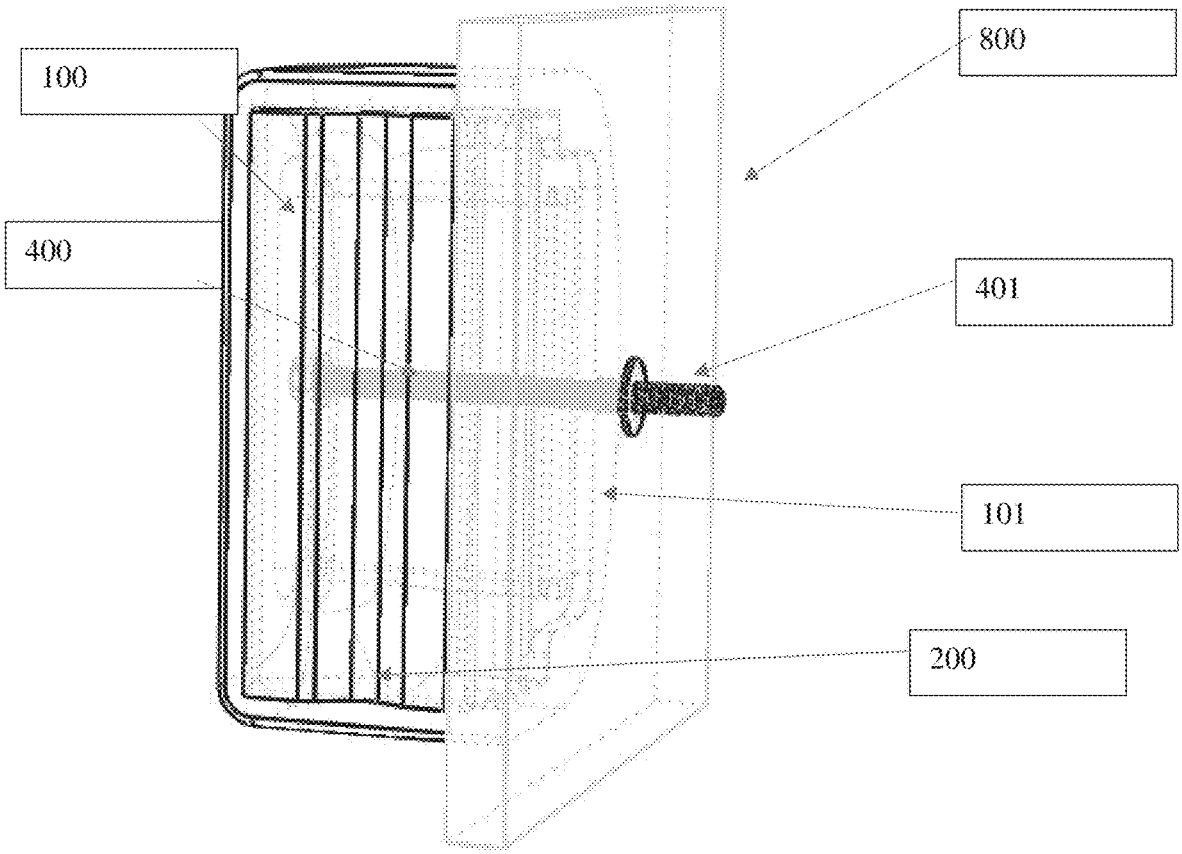
Figure 18:
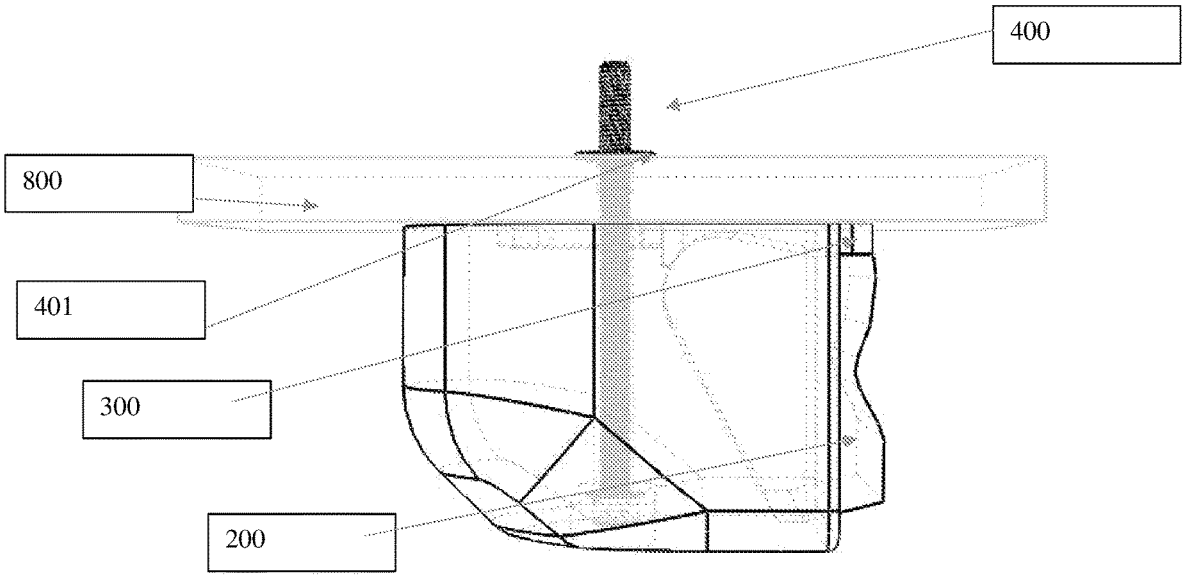

Referring to FIG. 11 the embodiment of the I-TCCH (100); sans it's overlaying Anchor, which would here be sandwiched between the I-TCCH Body and the Climbing Wal Surface, joined by the Bolt of the noted Slot, is shown, and demonstrates the protruding edge of the Shape Conforming Body in relation to the I-TCCH Body, at an angle of 0.1 or more degrees such that the compressive force of the Bolt being joined to a T-Nut or a Structural Member of the Climbing Wall via Nuts, compresses the Shape Conforming Body against the Stone Body and the Climbing Wall Surface to hold the Stone in place as shown in FIGS. 15-17.

Figure 19:
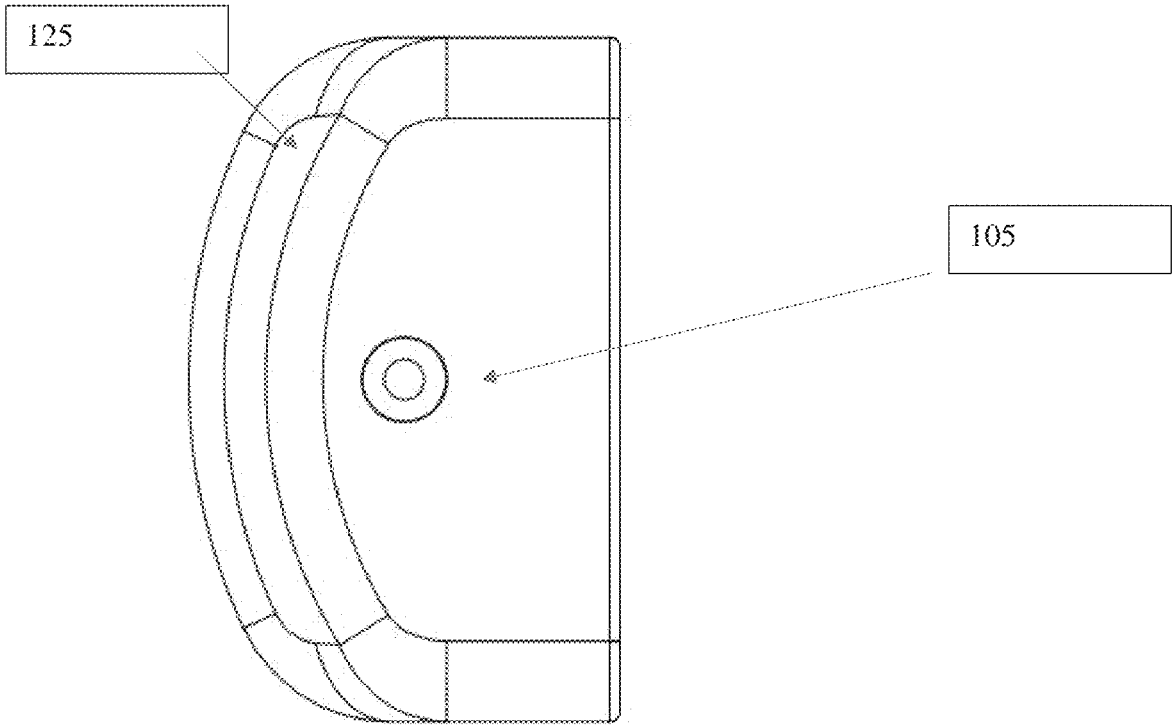
FIG. 19 shows the I-TCCH Body (125) without the Slotted Feature of (100), and with a Through Bolt Hole (105). The I-TCCH Body (125) is thus noted to have a through hole rather than the slotted hole of the I-TCCH Body (100).
Figure 20:
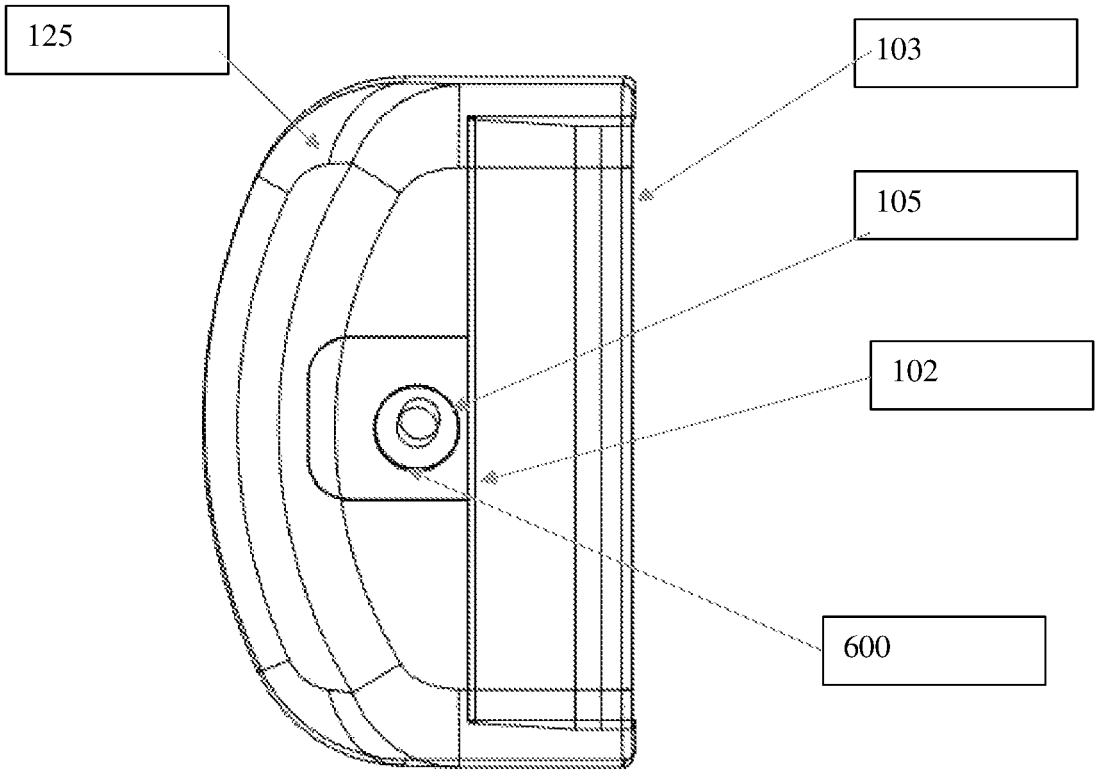
FIG. 20 shows the Body (125) of FIG. 19, with the Stone Cavity (103) for the Stone Body (200), as well as a Tab (102) for the fit of the Shape Conforming Body (300), and as a position reference for an Anchor (600) which would use the same connection point by Bolt (400) to the Climbing Wall (800).

FIG. 19 shows the embodiment of I-TCCH Body 125 in which the Slot is replaced with a countersunk Through Bolt Hole.

Figure 21:
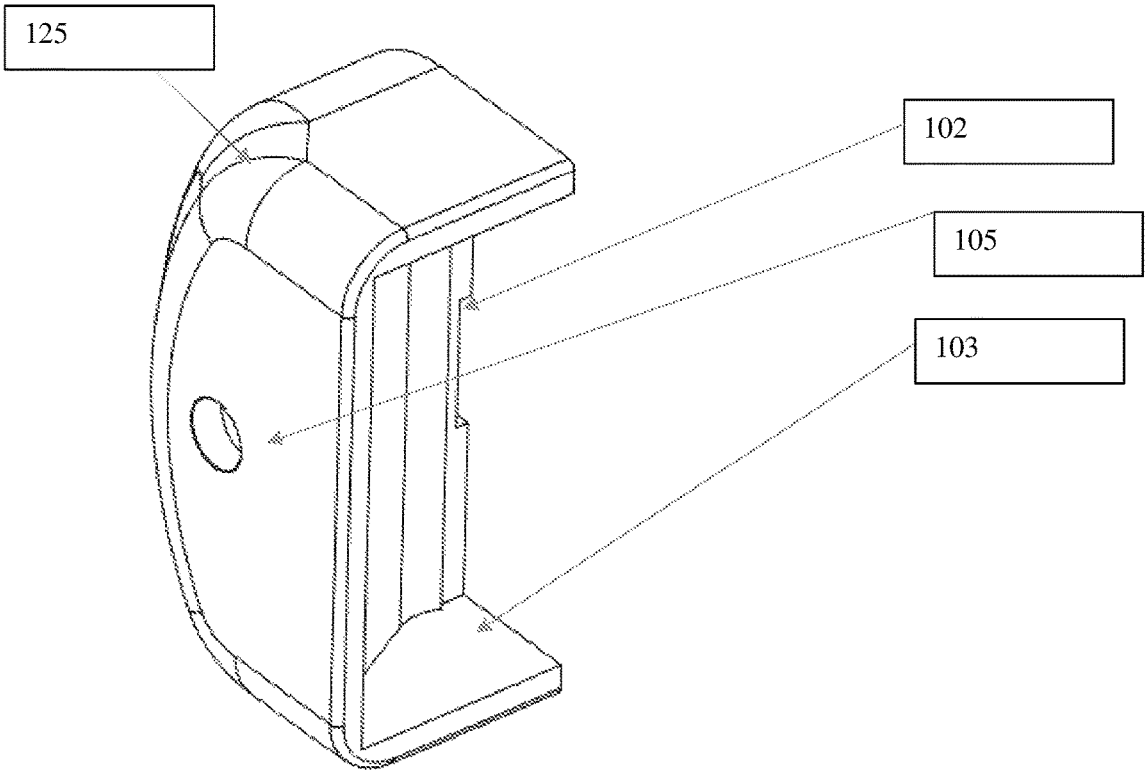
FIG. 21 is an isometric of FIG. 20 to expound upon references.
Figure 22:
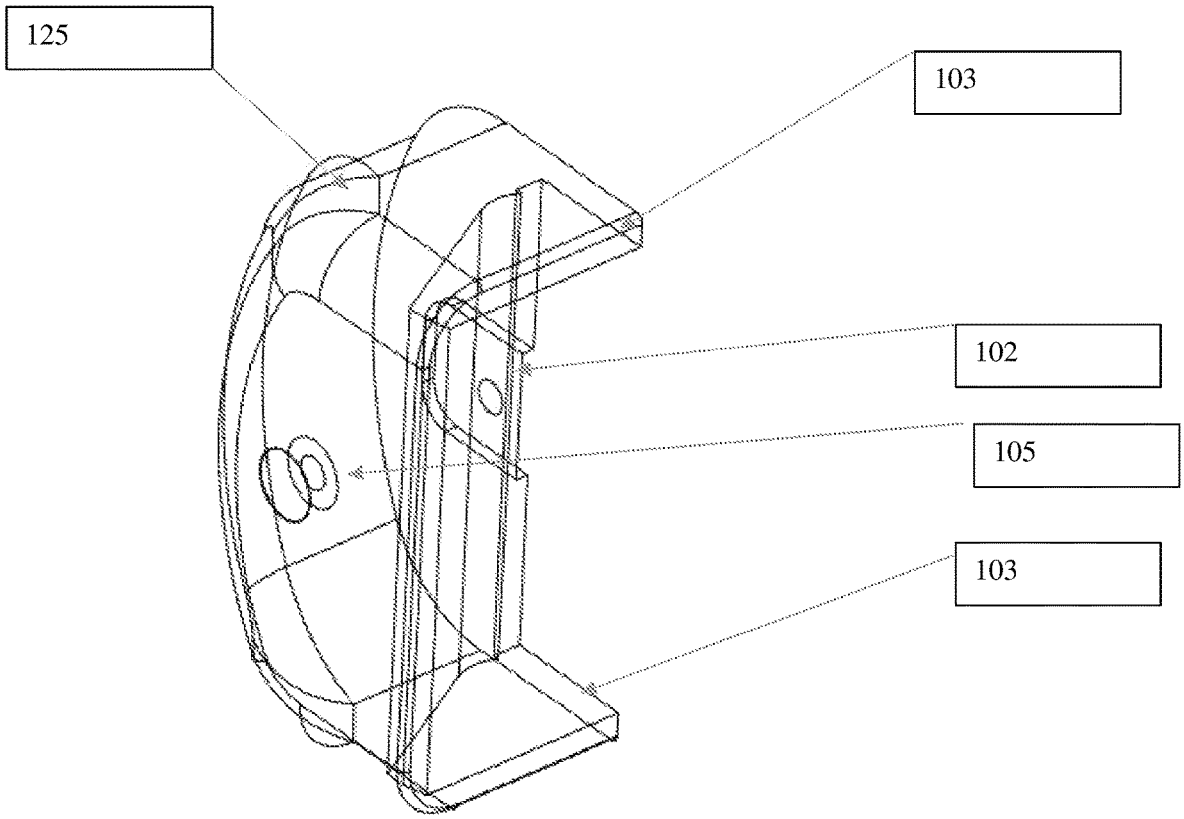
FIG. 22 shows that the clear view of the Body (125) of FIG. 20
Figure 23:
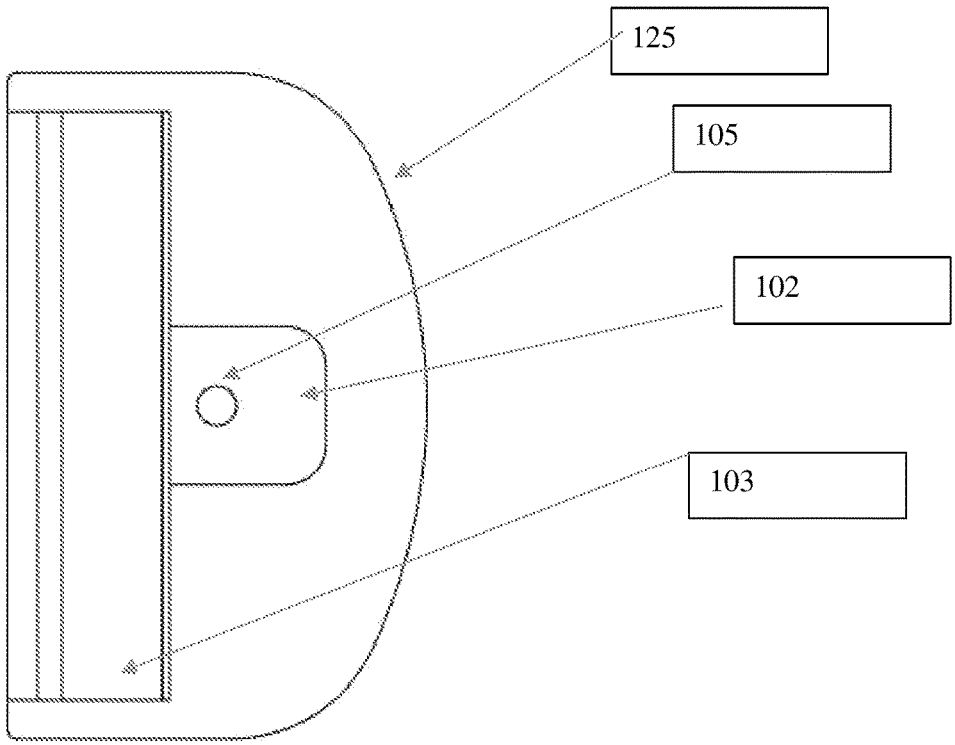
FIGS. 23, and 24 shows the rear view of the Body (125) of FIG. 20
Figure 24:
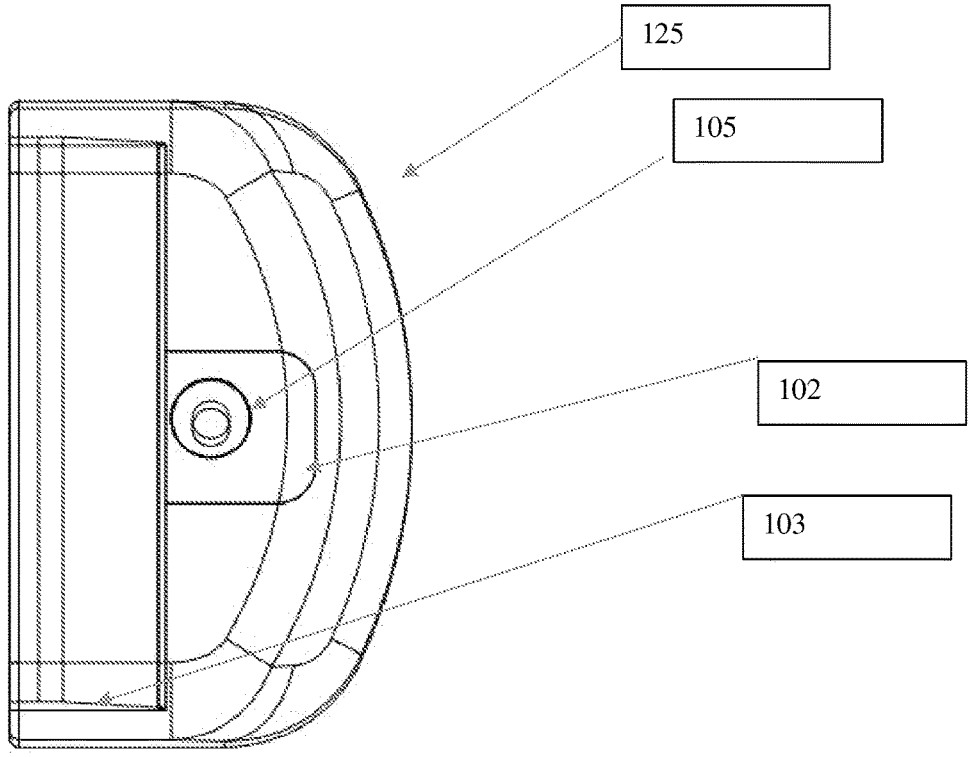

Referencing FIG. 21 the location for the Stone, and the Tab for the Anchor and the Shape Conforming Body is shown. In this instance, similar to the embodiment of FIG. 11 a Stone should be placed in the Cavity, and likewise the Shape Conforming Body then "caps" the Stone and can itself be further capped by an Anchor. The sum of which would then be bolted to a Climbing Wall Surface via a T-Nut or a Structural Member via Nuts.

Figure 25:
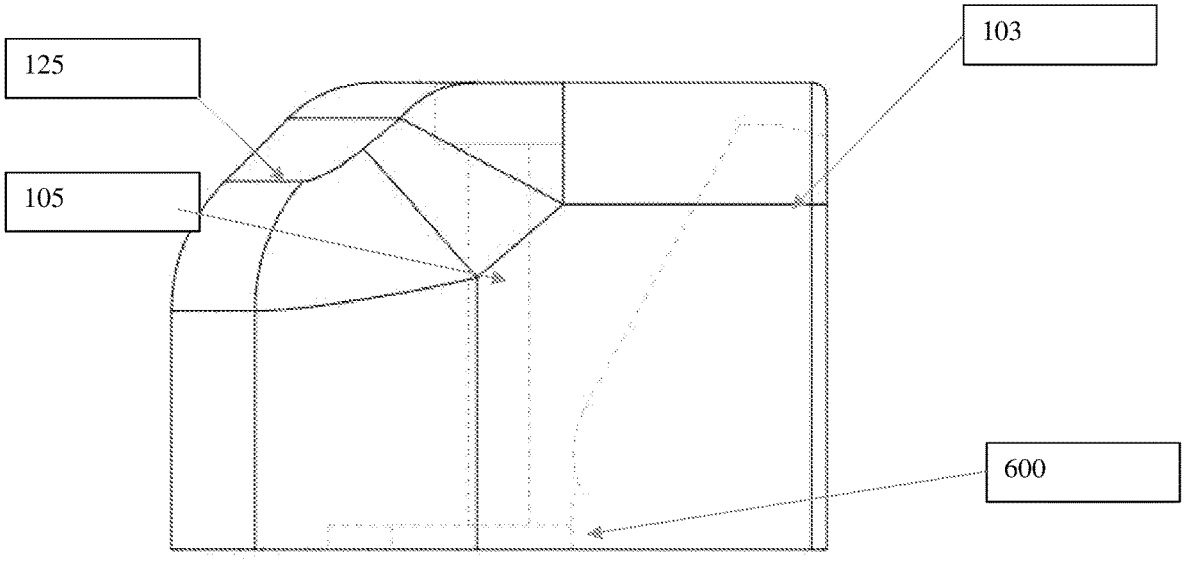
FIG. 25 shows the side view of the Body (125) of FIG. 20, noting particularly the Through Bolt Hole (105), the Body (125), the Anchor (600) location, and the Stone Cavity (103)
Figure 26:
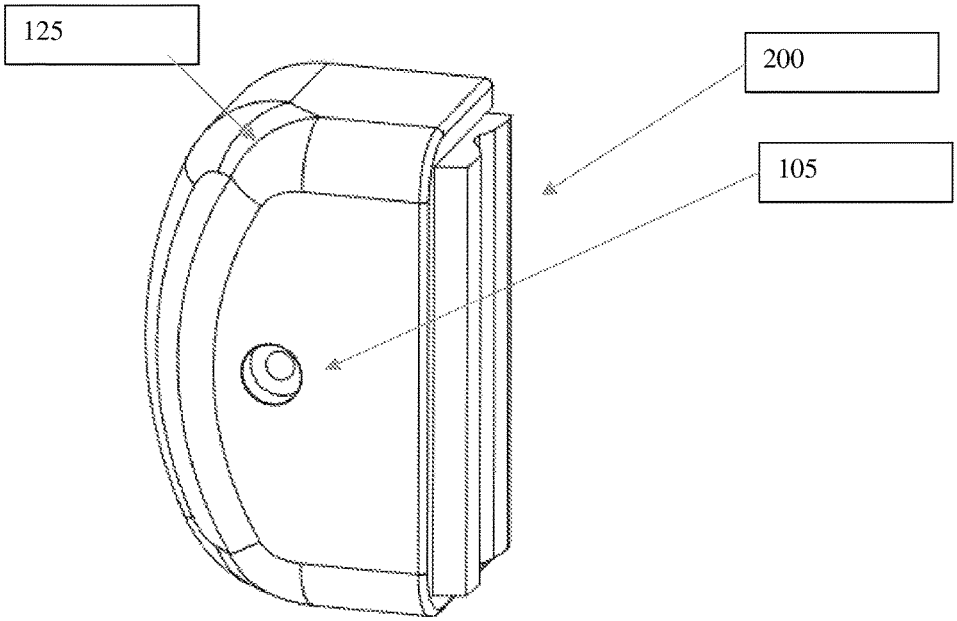
FIGS. 26, 27 shows the Body (125) of FIG. 20 with the Stone (200) in place, specifically in FIG. 27 noted is the Tab (102) for the Anchor (600) location of FIG. 20, and for the Shape Conforming Body (300)
Figure 27:
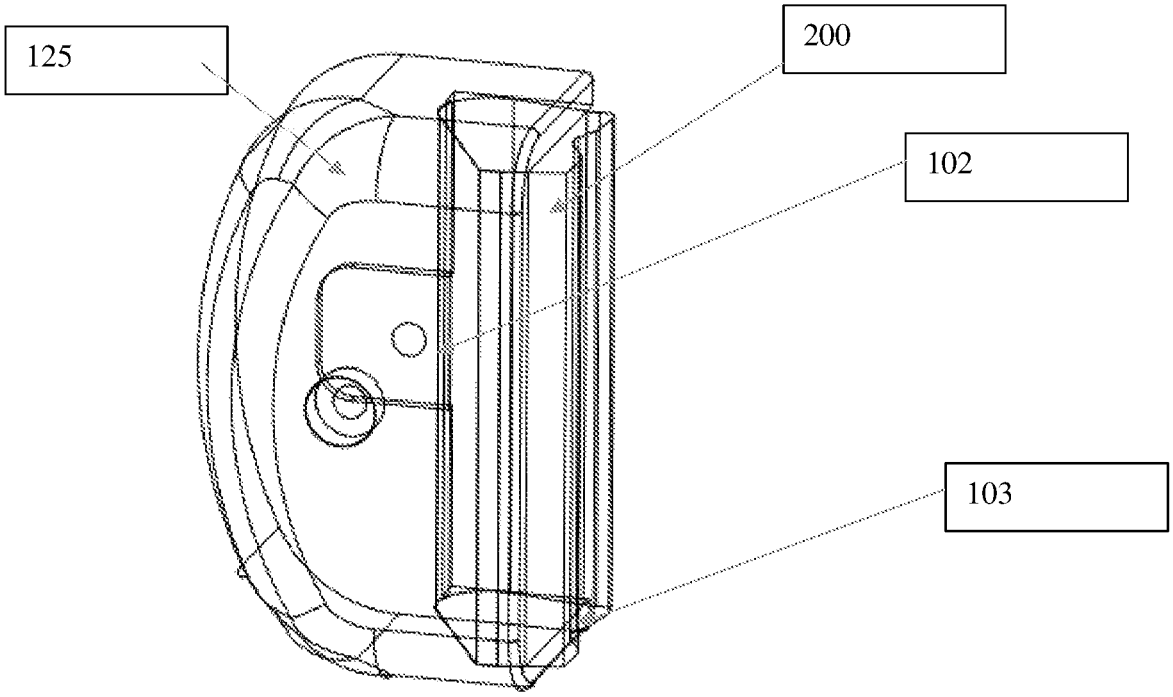
Figure 28:
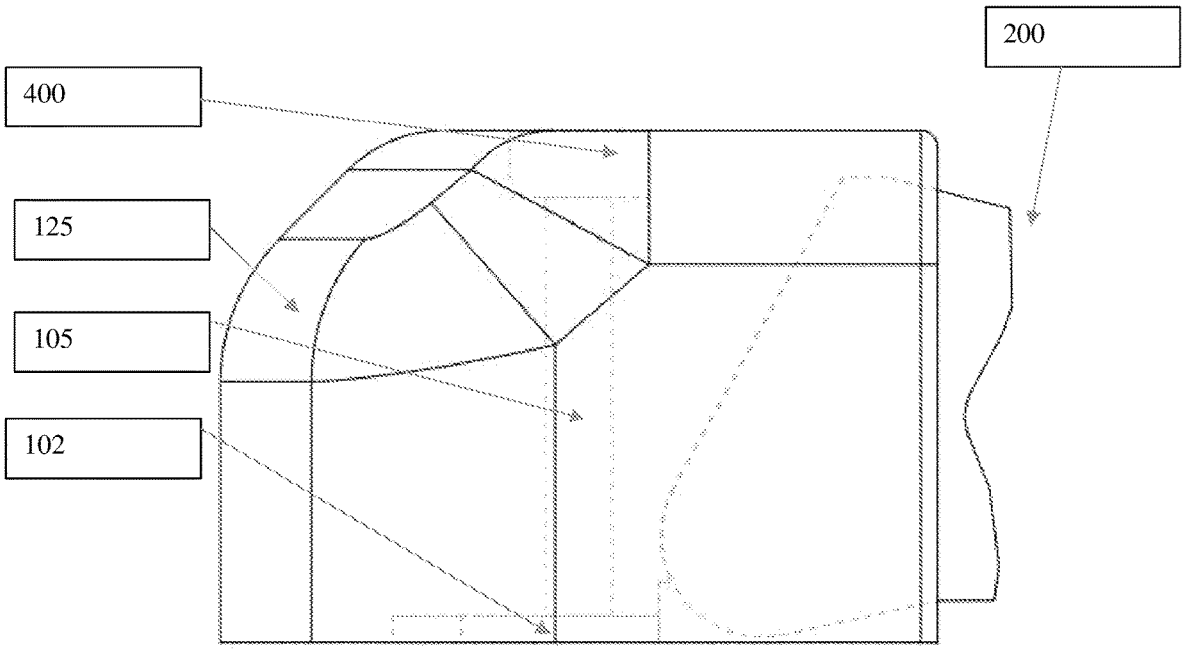
FIG. 28 shows the side view of the Body (125) of FIG. 20 with the Stone (200) in place
Figure 29:
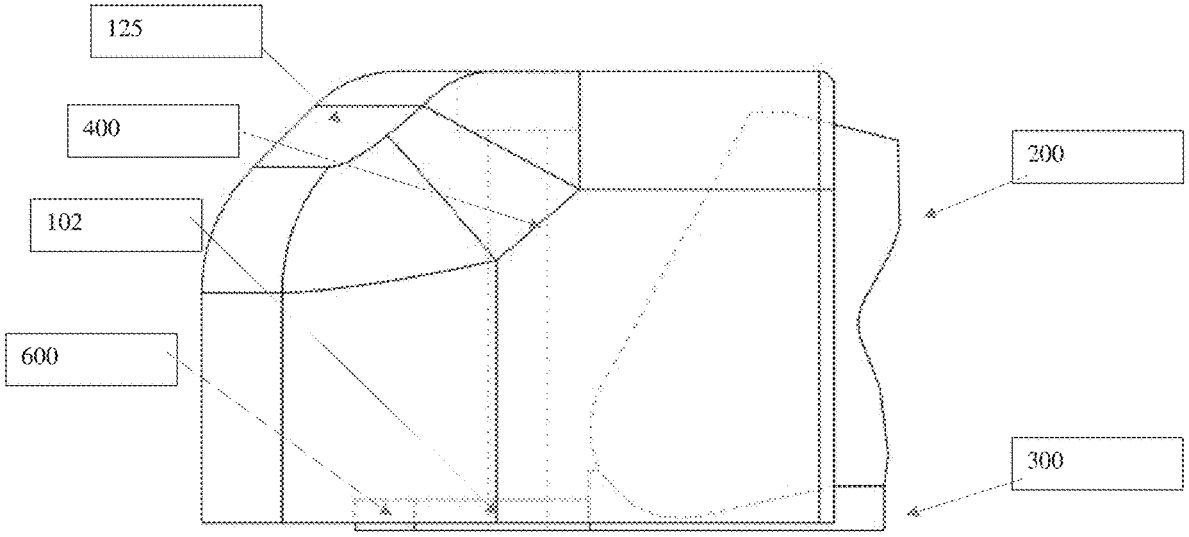
FIG. 29 shows the Shape Conforming Body (300) in place with the Stone (200). The removable Anchoring Body (600) can be conferred from this figure.

FIG. 25 shows the side view of the I-TCCH (125) embodiment to note the locations of the Anchor, Stone, Shape Conforming Body, and Bolt, in relation to a Climbing Wall Surface at its base. It stands to note that this variation, perhaps best shown in FIG. 26 rotates about a single point in relation to its pair and is therefore not additionally adjustable vertically or horizontally as the embodiment of FIG. 11 but is instead adjustable axially, 360 degrees.

Figure 30:
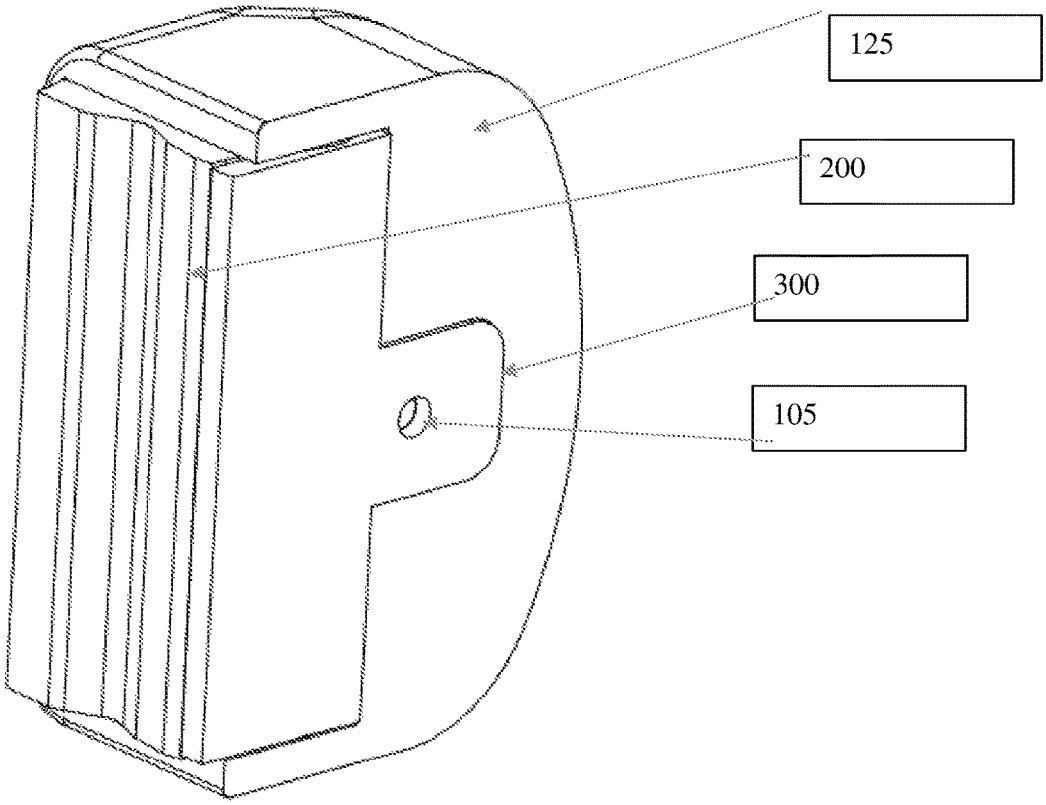
Figure 51:
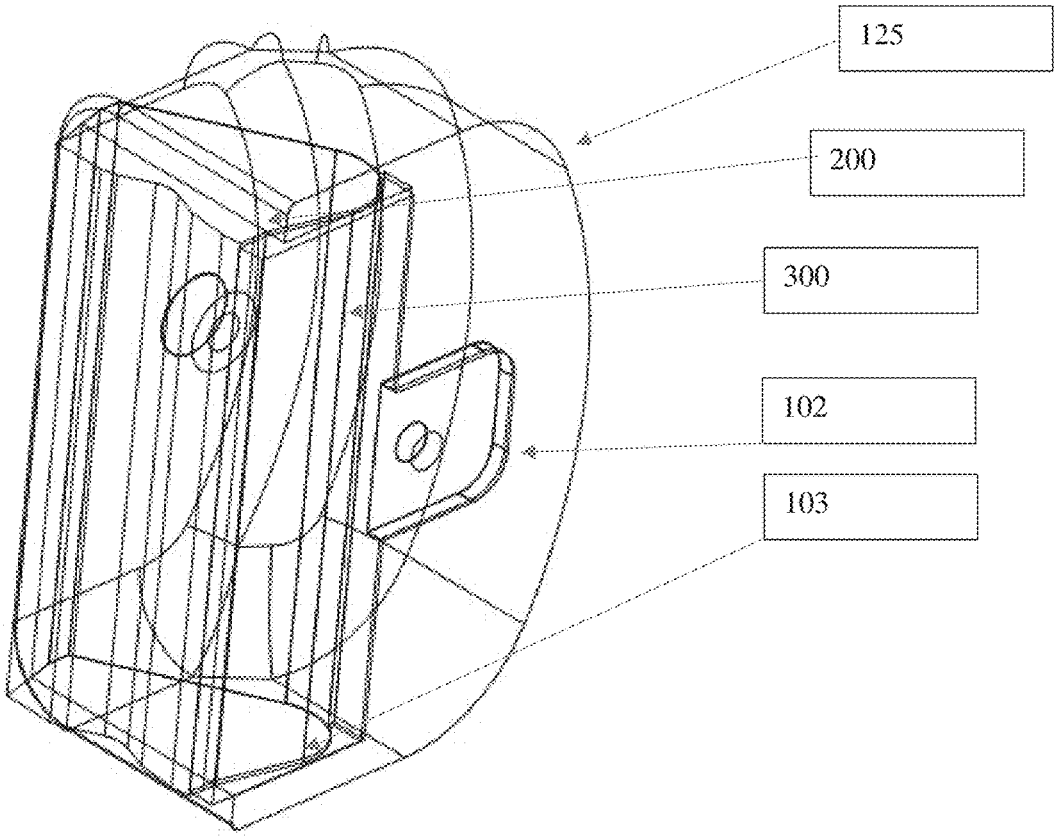

FIG. 30 shows the rear view of FIG. 25 and the sum of the bodies that make up the I-TCCH (125) embodiment, again sans the Anchor which would simply overlay the face to be sandwiched to the Climbing Wall Surface and connected by the aforementioned Bolt. This figure also points to the protruding edge of the Shape Conforming Body in relation to the I-TCCH Body, at an angle of 0.1 or more degrees such that the compressive force of the Bolt being joined to a T-Nut or a Structural Member of the Climbing Wall via Nuts, compresses the Shape Conforming Body against the Stone Body and the Climbing Wall Surface to hold the Stone in place.

Figure 32:
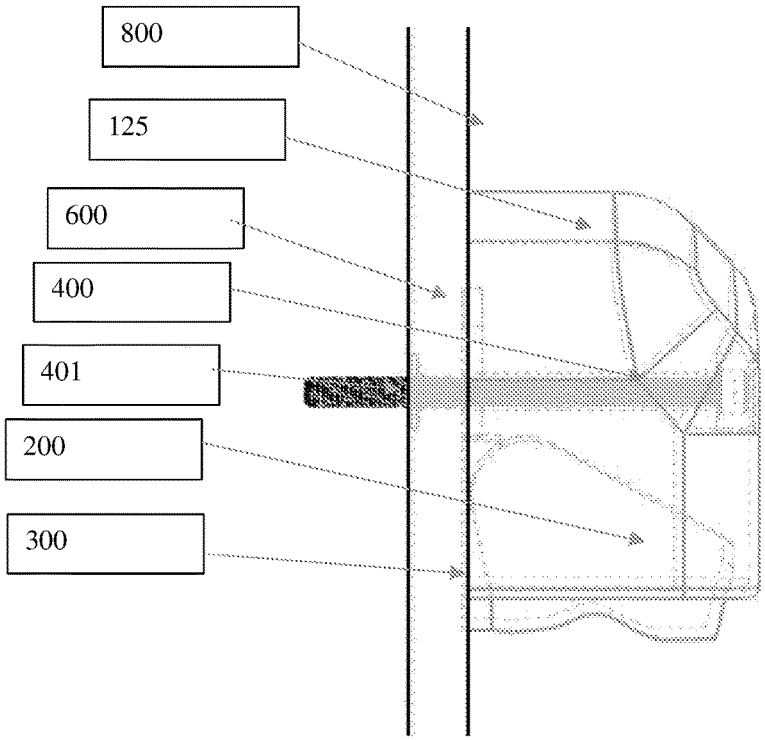
FIG. 32 shows the side view of FIG. 29 in combination with the Bolt (400), T-Nut (401) and Climbing Wall (800), and Anchor (600) exiting into the page.

FIG. 32 shows the sum of these bodies in such a form.

Figure 33:
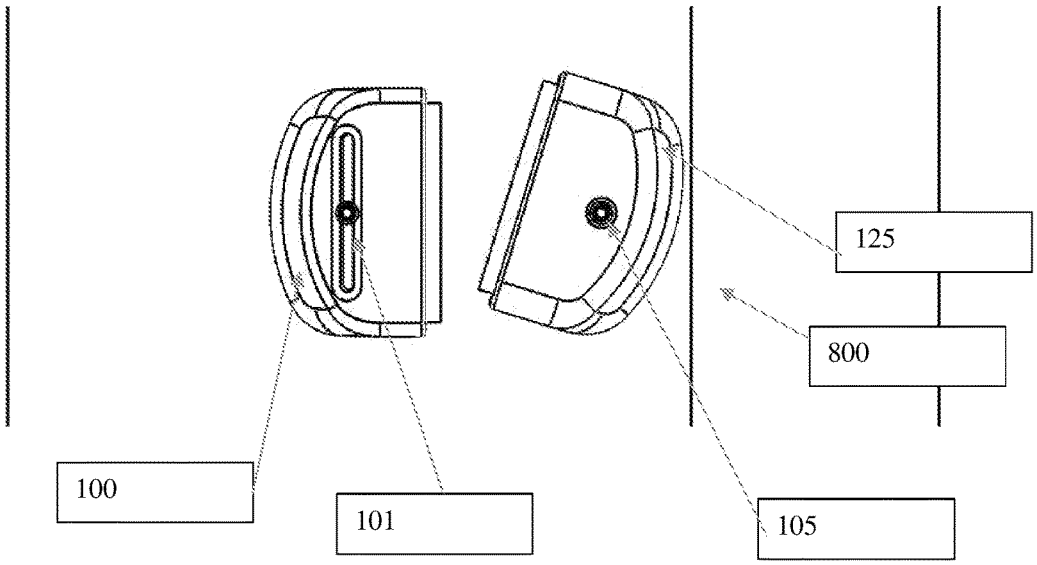
FIG. 33 shows two (2) I-TCCH Bodies (100 & 125) being placed on a climbing wall structure (800) in combination with one another. One body features a Slot (101) the other a single bolt hole (105)
Figure 34:
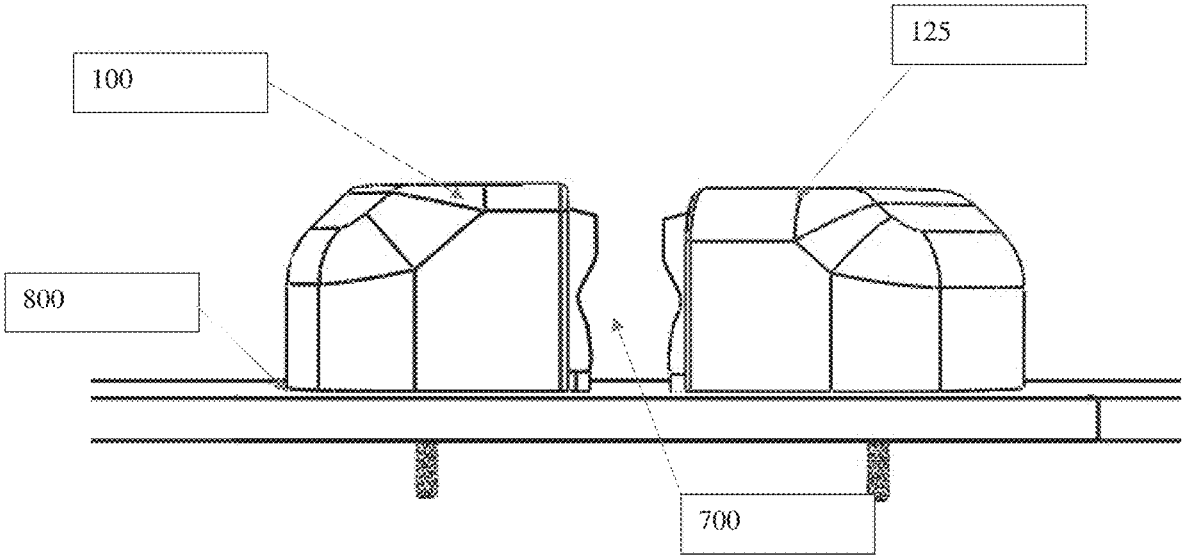
FIG. 34 shows a side view of two bodies (100 & 125) being used in combination on a climbing wall (800) and indicates the location for hand, foot, or gear placement (700).
Figure 35:
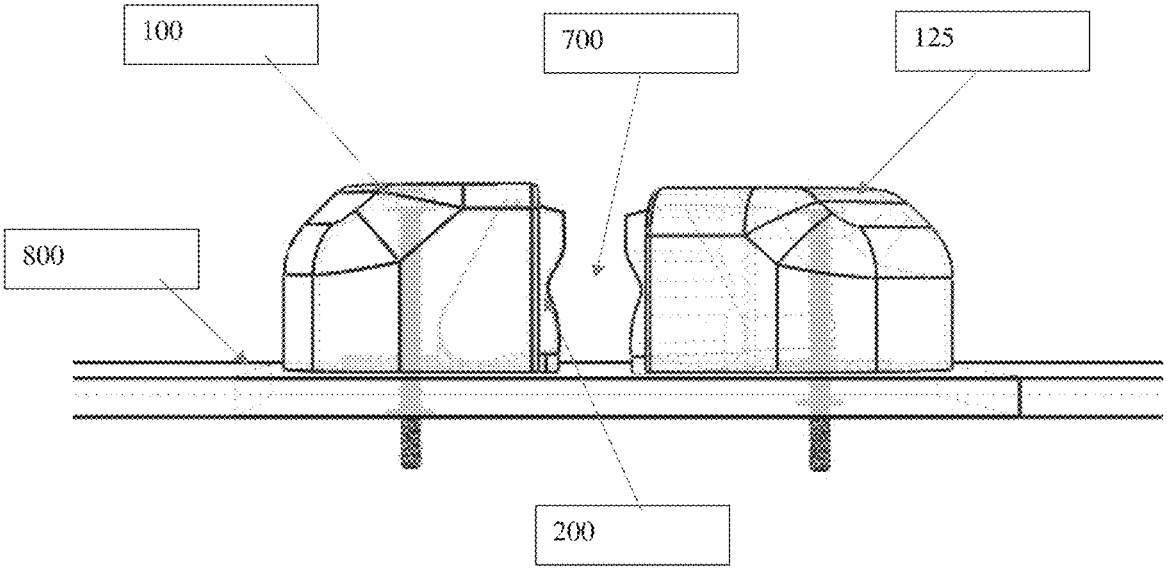

Referencing now FIG. 33 there is demonstrated the combination of any two I-TCCH embodiments (100, 125, 150) such that a "Crack Feature" is prorogated between the two bodies and their relation to one another creates a Crack between which a Climbers Hands, or Feet can be placed to gain traction or have grip such that the climber is able to gain a higher position in the climb in relation to a previous position.

Looking specifically at the I-TCCH Body 125 and its angle in relation to Body 100 one can conceptualize the variation of positions the combination of these devices can be configured into without detaching them from the Climbing Wall. Additionally, it can be conceptualized how either body rotated another number of degrees clockwise for the right most body and counterclockwise for the left most body could itself be used as a climbing feature for a climber to engage with their appendages to climb higher.

Figure 36:
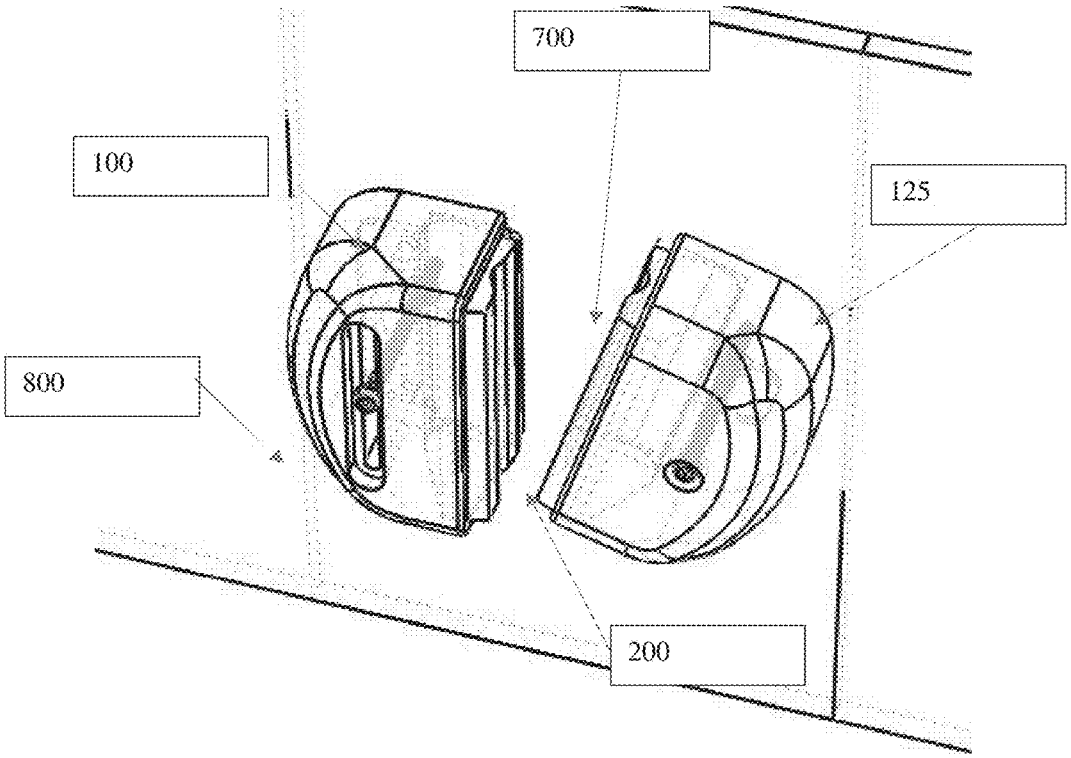
Figure 37:
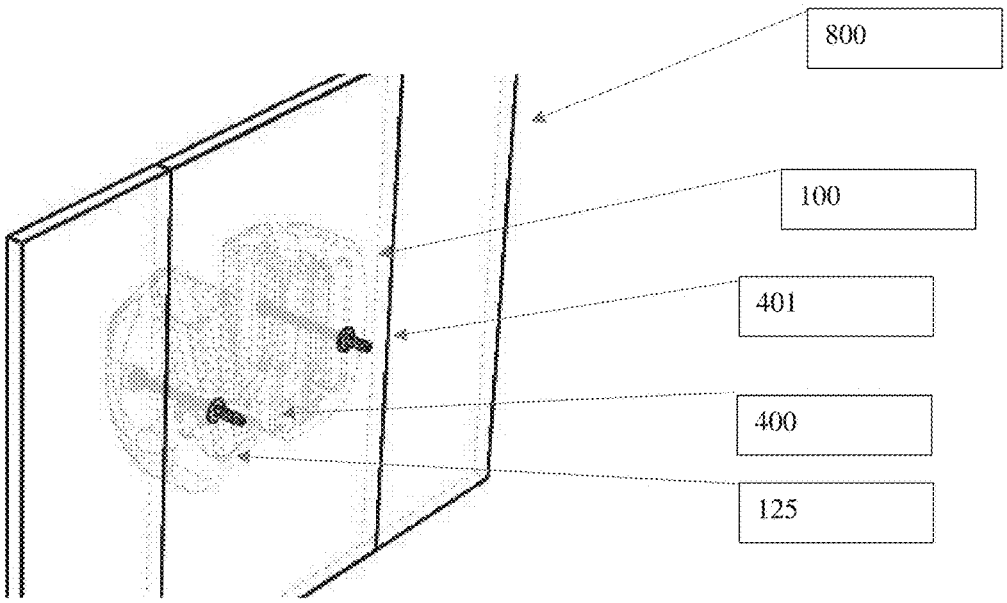
Figure 38:
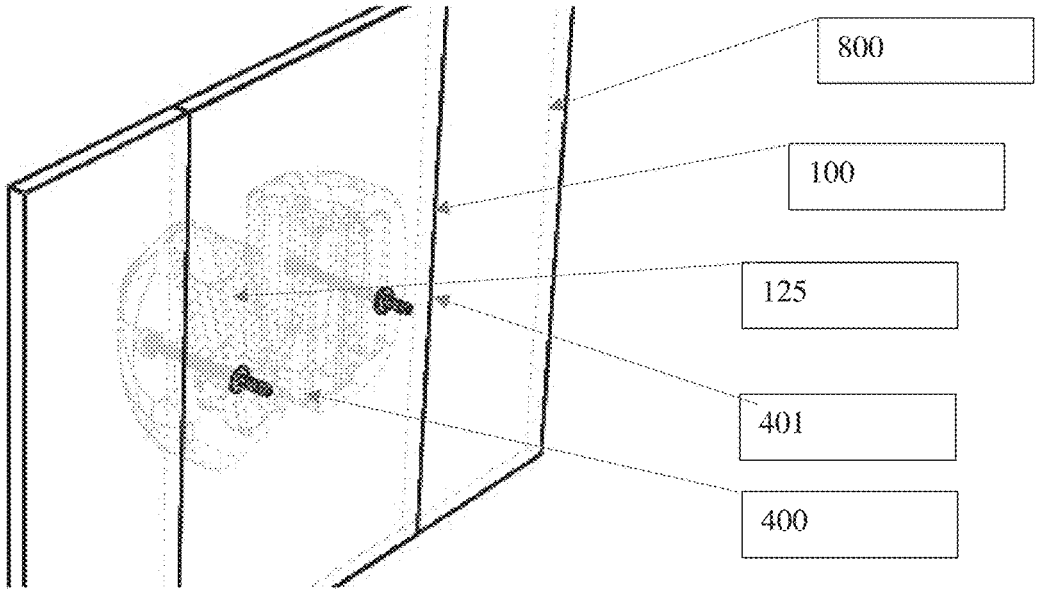

FIGS. 36, 37 show how the I-TCCH device can be sandwiched to the Climbing Wall Surface via a T-Nut, in a Non-Structural location like the connection of a regular climbing hold, for use as a Crack Feature.

Figure 39:
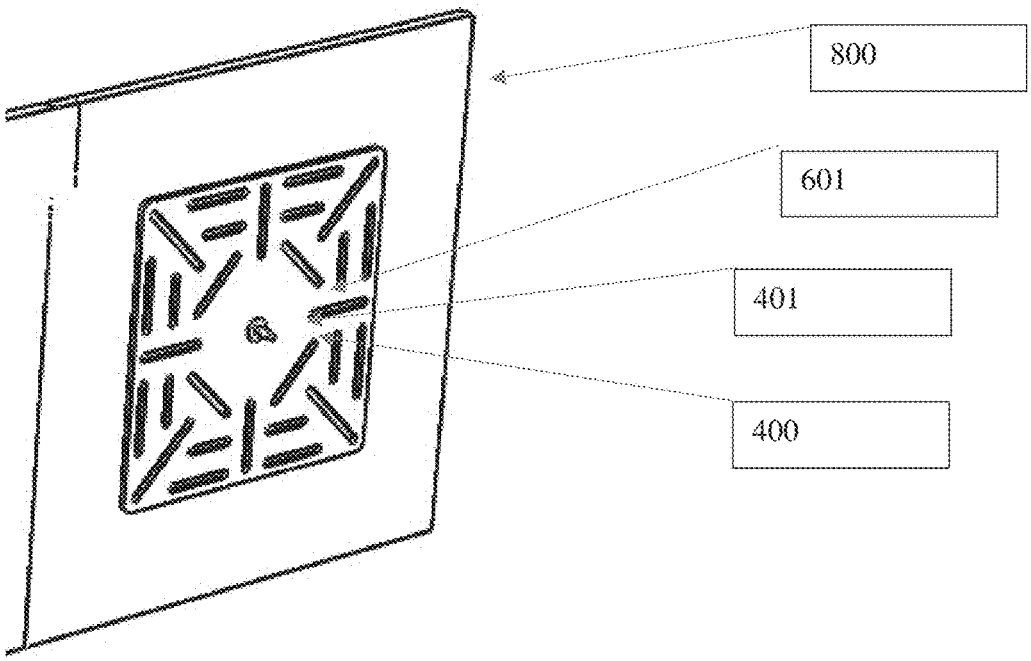
FIG. 39 shows the Sandwich Plate (601) attached to the Interior of the Climbing Wall (800) creating a structural member

Referencing FIG. 39 in relation to FIGS. 36 and 37, as it pertains to the addition of the Sandwich Plate behind the Climbing Wall Surface. The addition of this Sandwich Plate creates a Structural Point. The Sandwich Plate itself can be welded to an existing structural member of the Climbing Wall or be connected over existing T-Nuts to "sandwich" the Climbing Wall Surface between the I-TCCH Body and the Plate thereby increasing the engaging surface area of the I-TCCH Body and creating a Structural Member.

Figure 40:
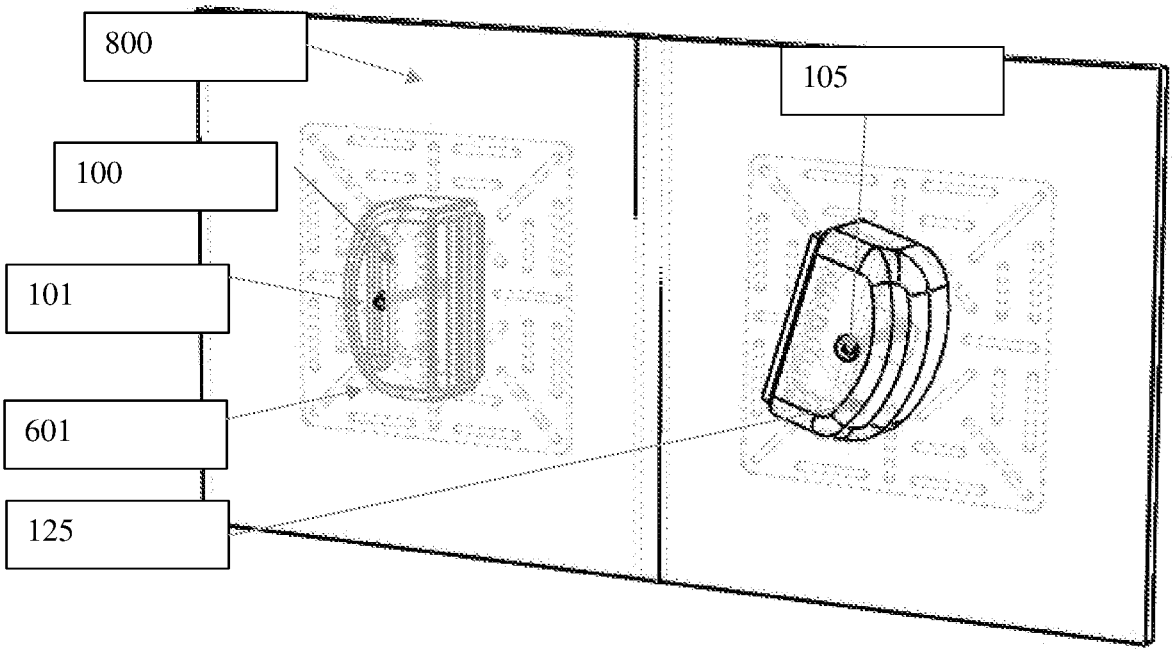
FIG. 40 shows the I-TCCH (100 & 125) used in combination with the Sandwich Plate (601) of FIG. 39, both as a slotted (101) and single hole (105) device. To note: A single Sandwich Plate (601) can be used with multiple I-TCCH Bodies.
Figure 41:
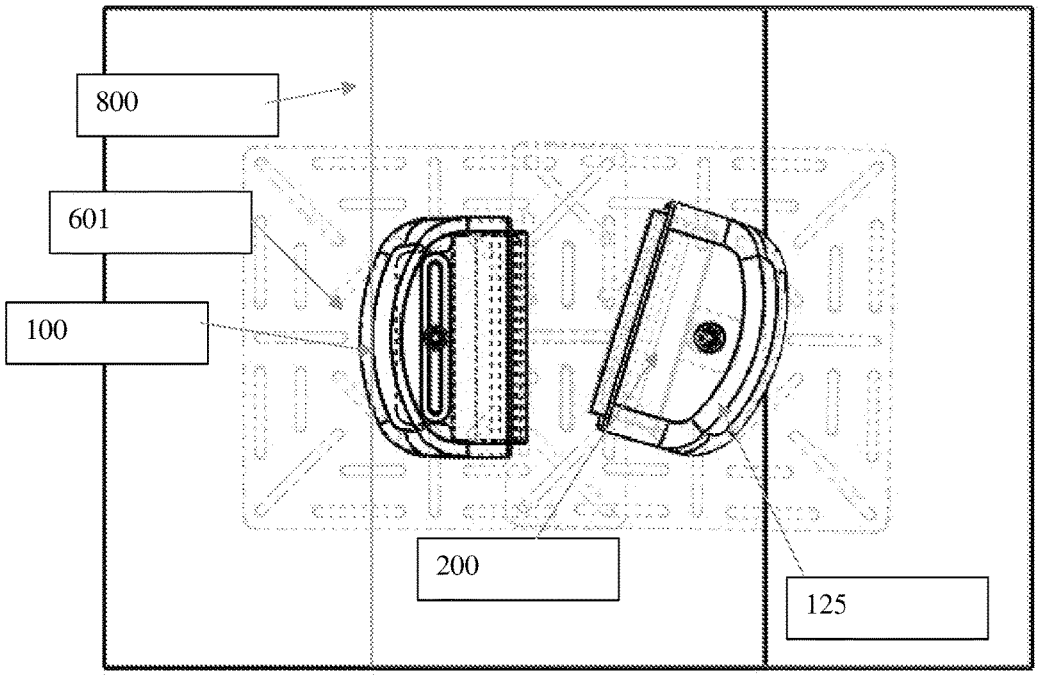
FIG. 41 shows the I-TCCH (100 & 125) devices being used in combination with one another and in combination with one or more Sandwich Plates (601)
Figure 42:
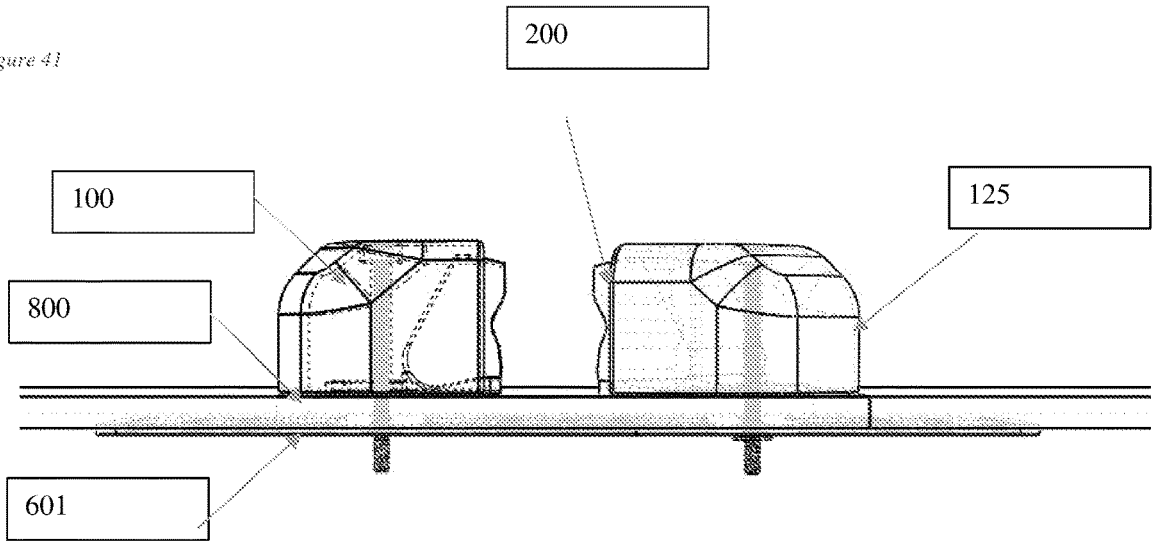
FIG. 42 shows the side view of FIG. 41

The slots shown in the Sandwich Plate in FIG. 39 are simply points by which the I-TCCH Body can be connected individually (FIG. 40), in multiplicity (FIG. 41), or by which connections can be made to existing structural members of the Climbing Wall (FIG. 42).

Figure 43:
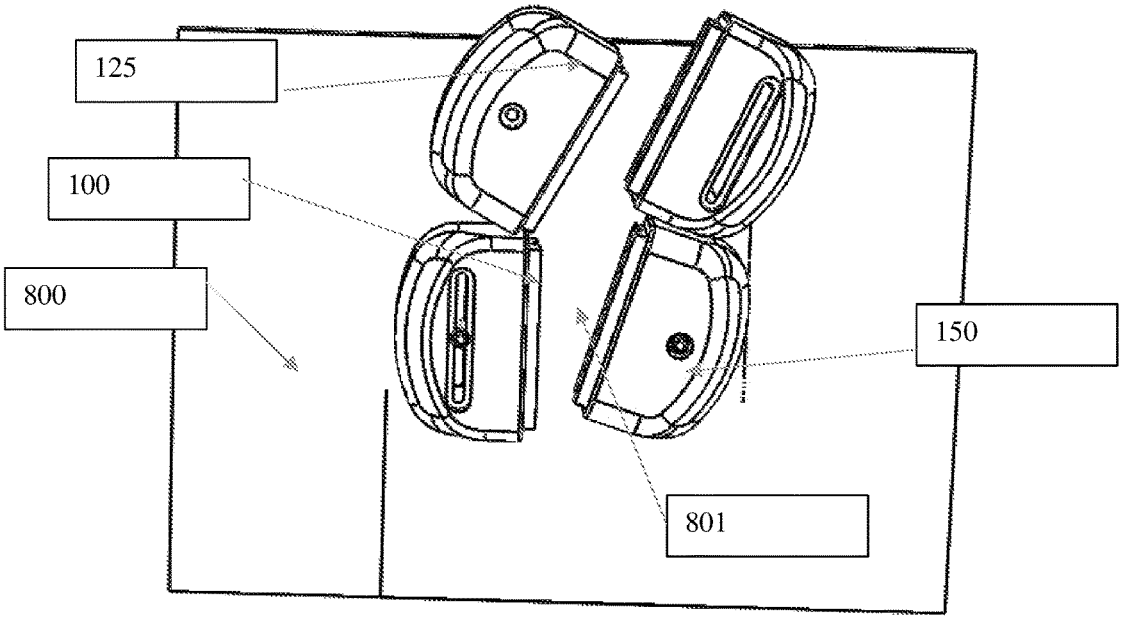
FIG. 43 shows a combination of I-TCCH (100 & 125 & 150) devices being used to form a Continuous Crack Feature (801) which is noted to be the area between the combination of I-TCCH device variations, otherwise known as a "crack".

FIG. 43 shows all three embodiments of the I-TCCH (100, 125, 150) used in combination to create a Continuous Crack Feature. There is an obviousness to the number of variations and combinations these embodiments can be configured in to reach an infinite length across a Climbing Wall Surface that will not be explained here. It stands to note as Crack Climbing is defined that the depiction in FIG. 43 specifically relates to the form of Crack Climbing using one's hands and feet or any combination of those appendages between two parallel surfaces.

Figure 44:
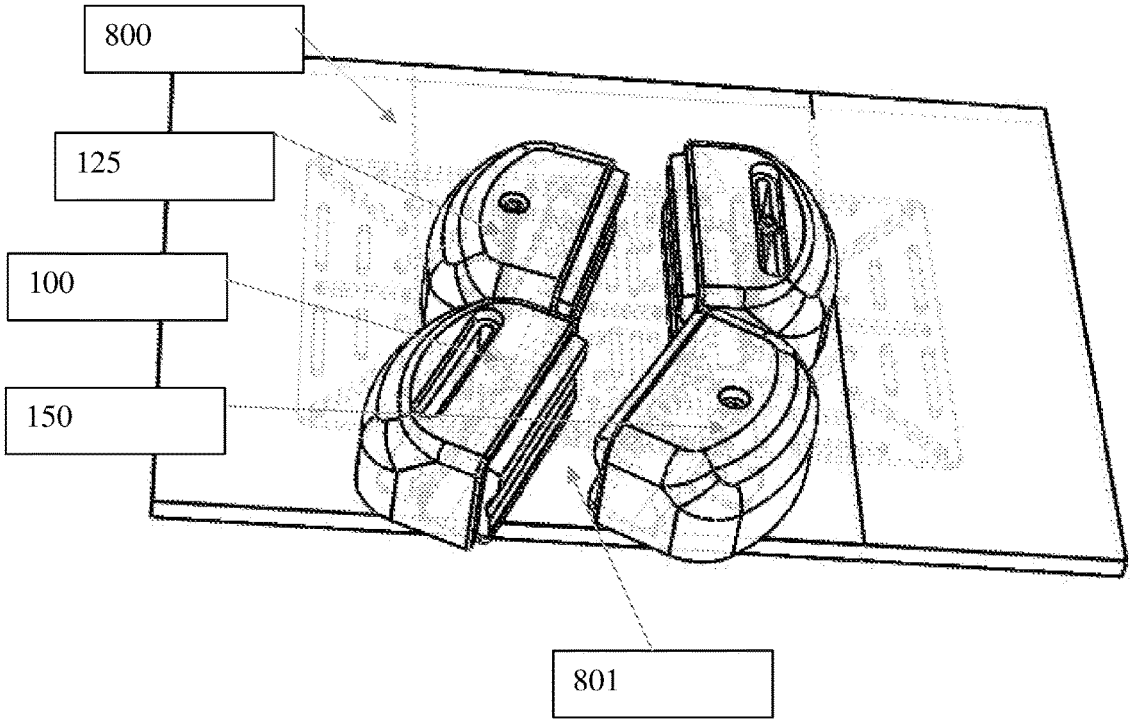
FIG. 44 shows an isometric view of FIG. 43, in such a position for one to confer upon the image the positioning of Traditional Gear placements (700) as depicted in later FIGS. 57 & 58 within the Continuous Crack Feature (801).

FIG. 44 shows the combination of the aforementioned embodiments similarly placed/positioned in combination with the Sandwich Plates which thereby create a Structural Member off which the I-TCCH Bodies can be Loaded with more weight than that referenced by the human body, and by more force than that generated by the fall and resulting impact of the human body. Directly in relation to this structure the I-TCCH Body (150) and its necessary components are further described.

Figure 45:
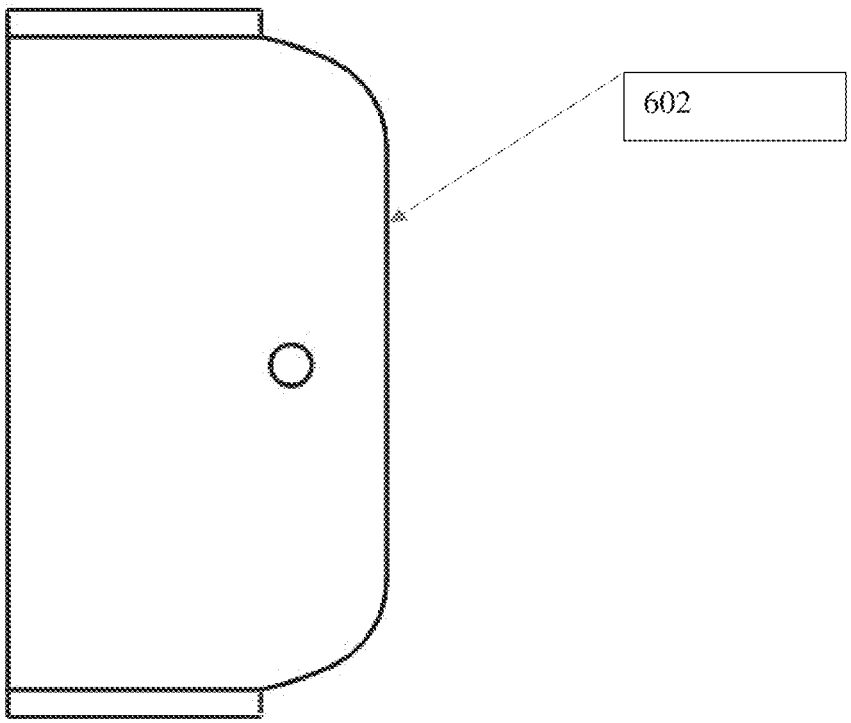
FIGS. 45 and 46 shows the Structural Plate (602) for insertion into the I-TCCH Body (150) FIG. 47, by which to increase the robustness of the I-TCCH Body (150) in such a way that it becomes a structural member of the climbing wall (800).
Figure 46:
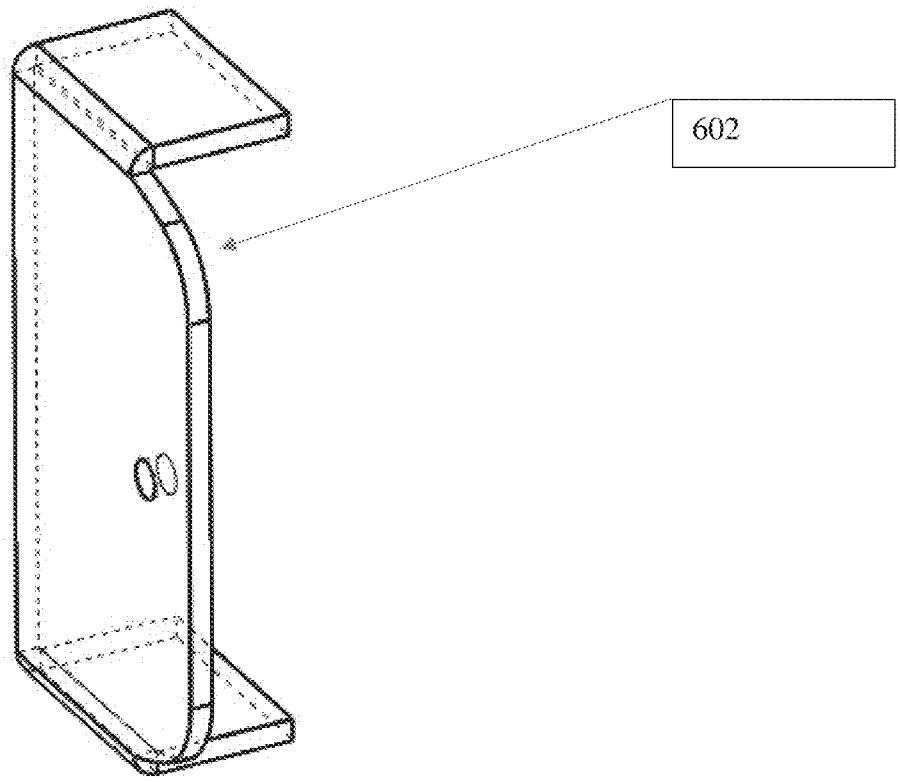
Figure 47:
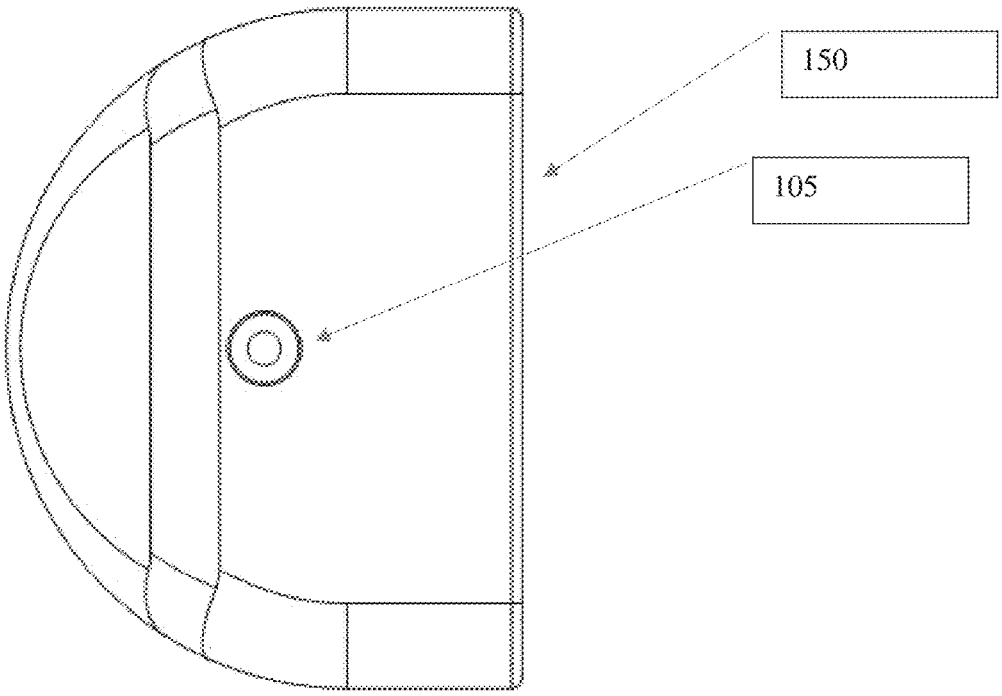
FIGS. 47 and 48 shows the body (150) that receives FIG. 45, and the Structural Plate Cavity (151) in which the Structural Plate (602) is inserted. It stands to note that by way of manufacturing, the Structural Plate (602) can be "over-molded" by the I-TCCH Body (150) rather than inserted into the cavity.
Figure 48:
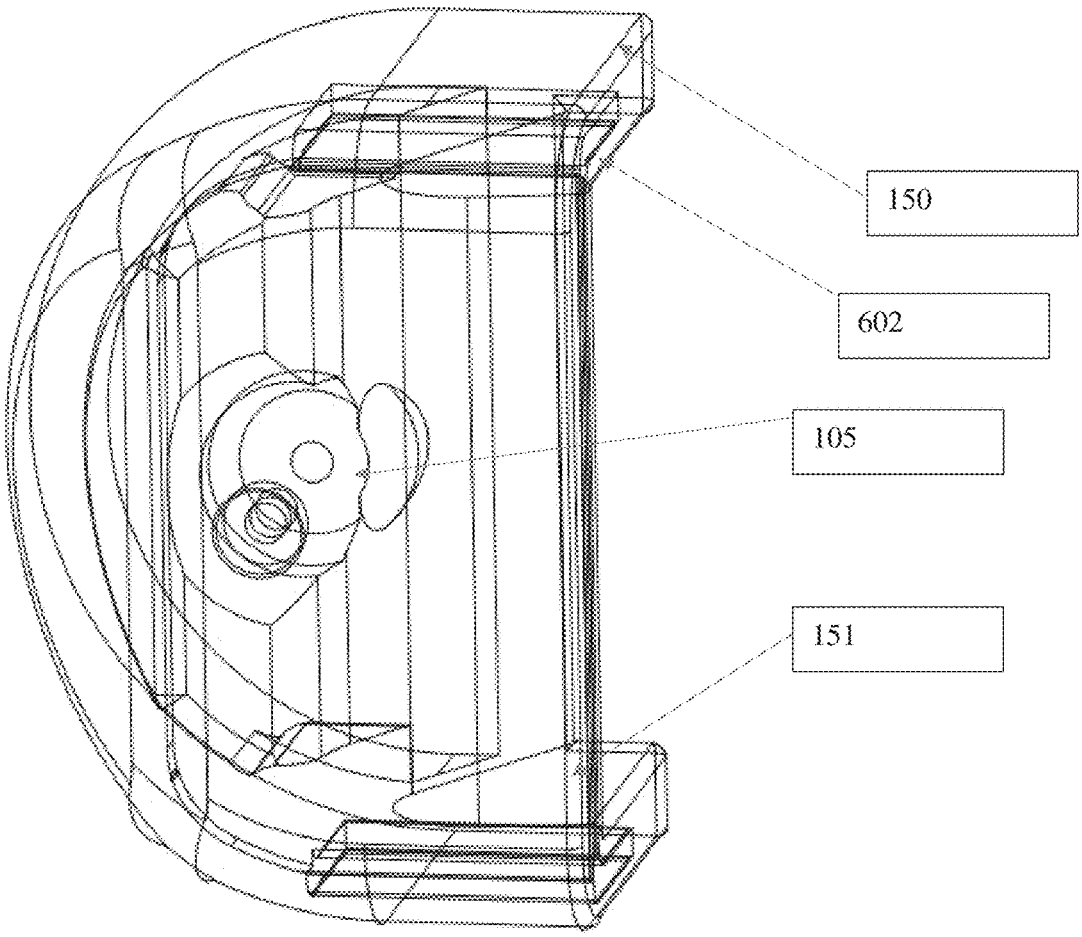
Figure 49:
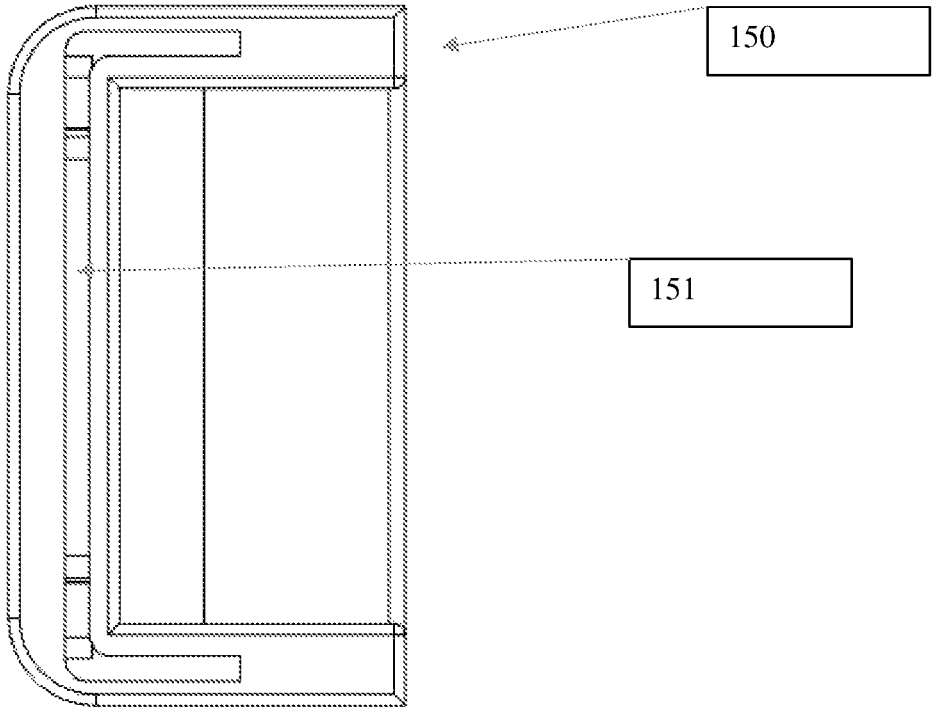
FIGS. 49 and 50 shows the Structural Plate Cavity (151) that receives the Structural Plate (602) of FIG. 45

Specifically FIG. 45 which shows the Structural Plate for insertion into the I-TCCH (150) Body via the Structural Plate Cavity of FIG. 48 through which the Bolt Hole of FIG. 47 aligns with that of the Structural Plate such that when the sum of these bodies are combined with the Shape Conforming Body and a Bolt they in sum become a Structural Member of the Climbing Wall to handle a load greater than 5 KN, and an impact load greater than 8 KN.

Looking at FIG. 47, the Bolt Hole while not slotted in depiction can be slotted in combination with the item of FIG. 45 namely the Structural Plate such that in mobility prior to completely securing the I-TCCH in place the embodiment (150) can be adjusted linearly or rotated to achieve a position chosen by the setter before being secured to the Climbing Wall.

Figure 50:
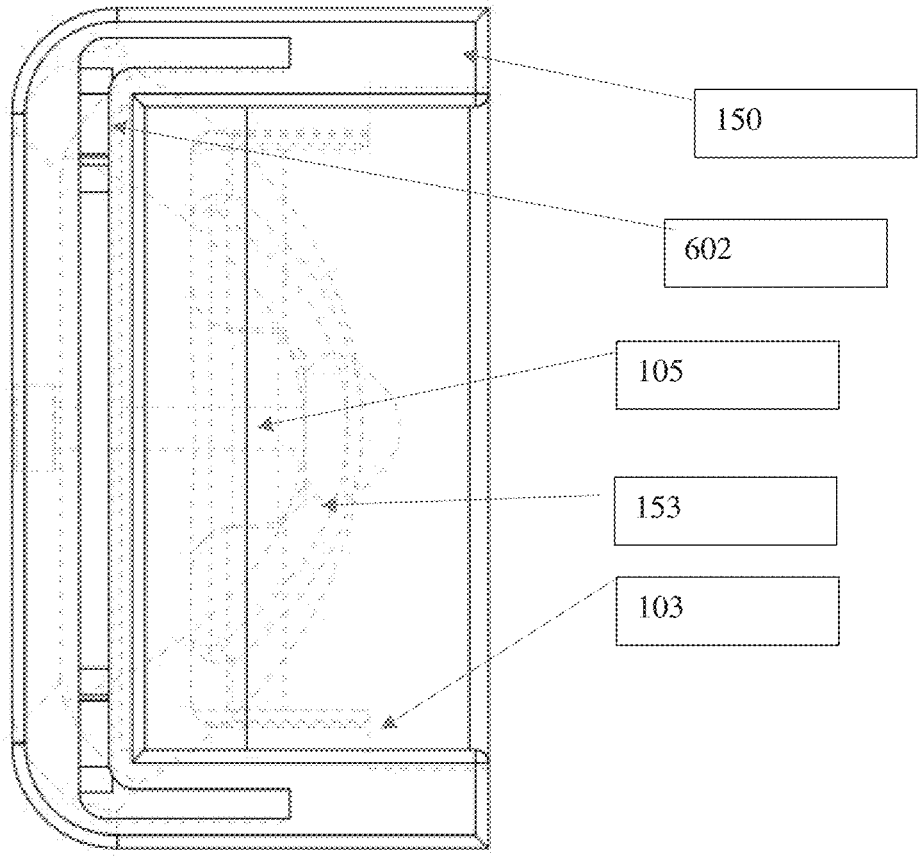
Figure 51:
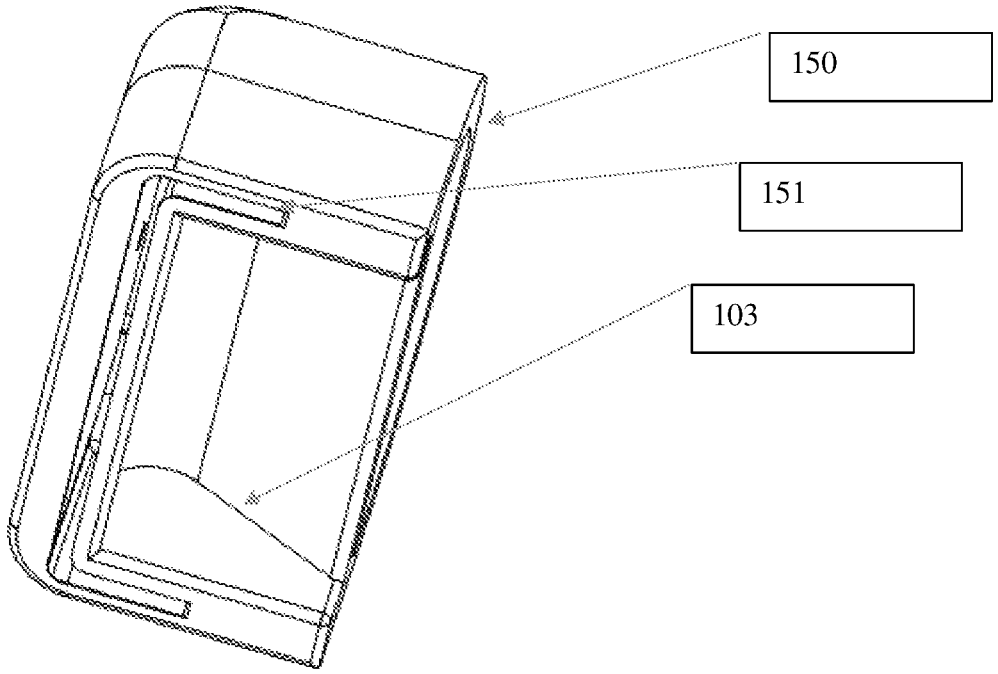

FIG. 50 while a depiction of the I-TCCH (150) embodiment can relate to any of the three embodiments in that an additional Rear Cavity exists such that as compression increases between the rear surface of an I-TCCH, and the Climbing Wall Surface, suction is created to prevent rotation of the I-TCCH under extreme loading or high force impacts.

Figure 52:
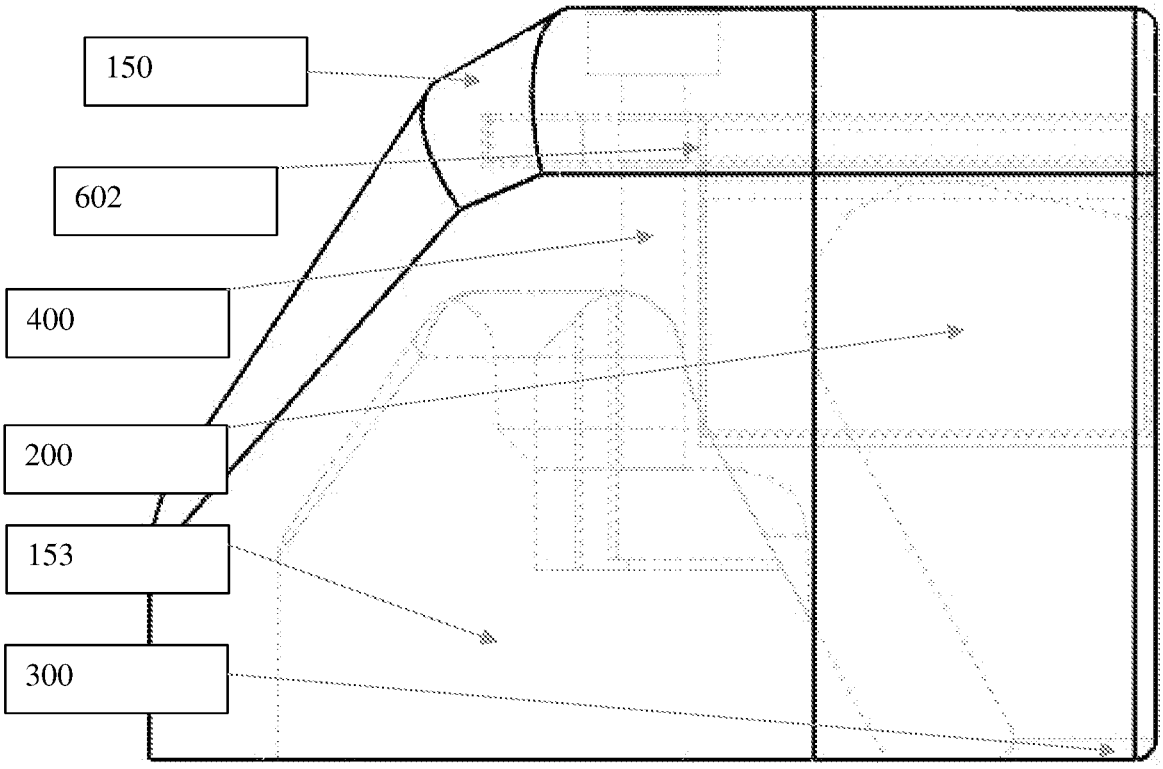
Figure 53:
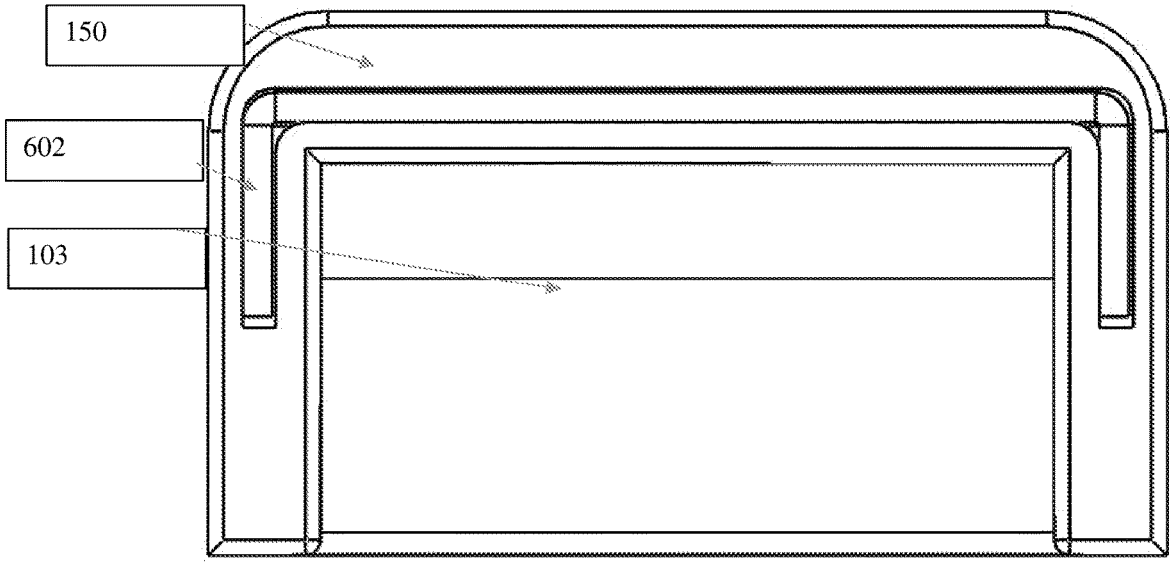
FIG. 53 shows the Structural Plate (602) of FIGS. 45 and 46 inserted into the I-TCCH Body (150)
Figure 54:
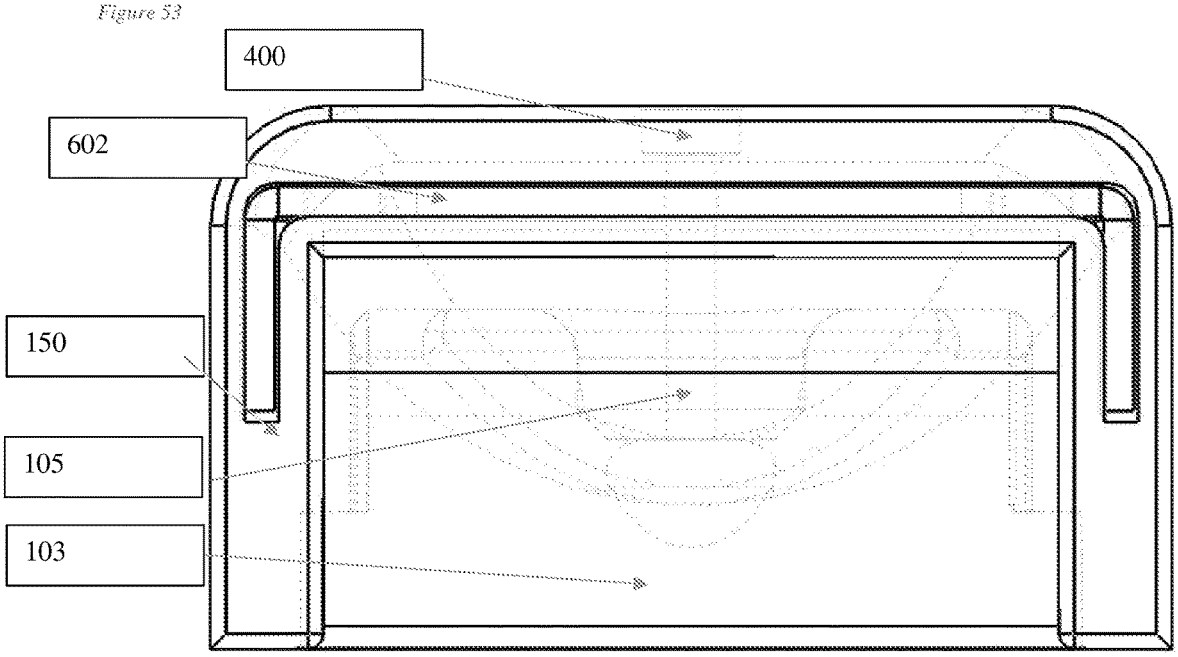
FIG. 54 expounds upon FIGS. 53 and 52

This Rear Cavity is shown in relation to the Stone Cavity in FIG. 52, as not impeding of the Bolt access to reach through the Climbing Wall Surface and not weakening of the structure that retains the Stone, and not weakening of the structure that retains the Structural Plate.

Figure 55:
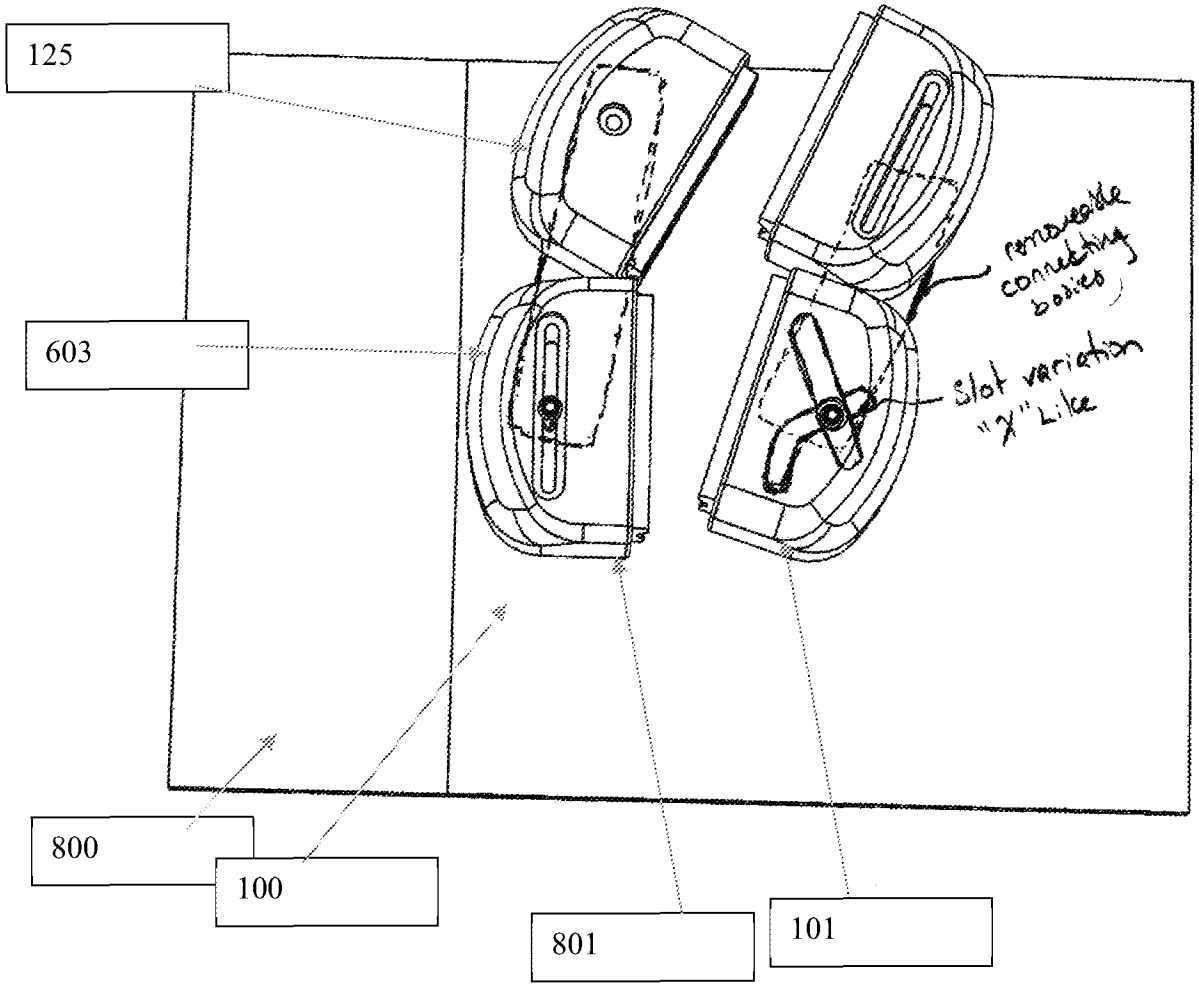
FIG. 55 shows the Linking Plate (603) a removable connecting feature that creates a modular connection between two devices which together form a Continuous Crack Feature (801); as well as the Slot (101) directional changes on the I-TCCH (100) Body.

FIG. 55 shows a connecting feature that serves to Anchor I-TCCH to I-TCCH in addition to securement to the Climbing Wall Surface with incremental positioning that allows for the position of the Anchor and Connector to be rotated to any position around the primary Bolt connected to a Structural Member of the Climbing Wall. Further it depicts the change of Slot direction, position, and quantity on the I-TCCH Body which creates different modes of arrangement of the I-TCCH Body in relation to other I-TCCH Bodies such that new Crack Features can be continually prorogated with minute changes in position.

Figure 56:
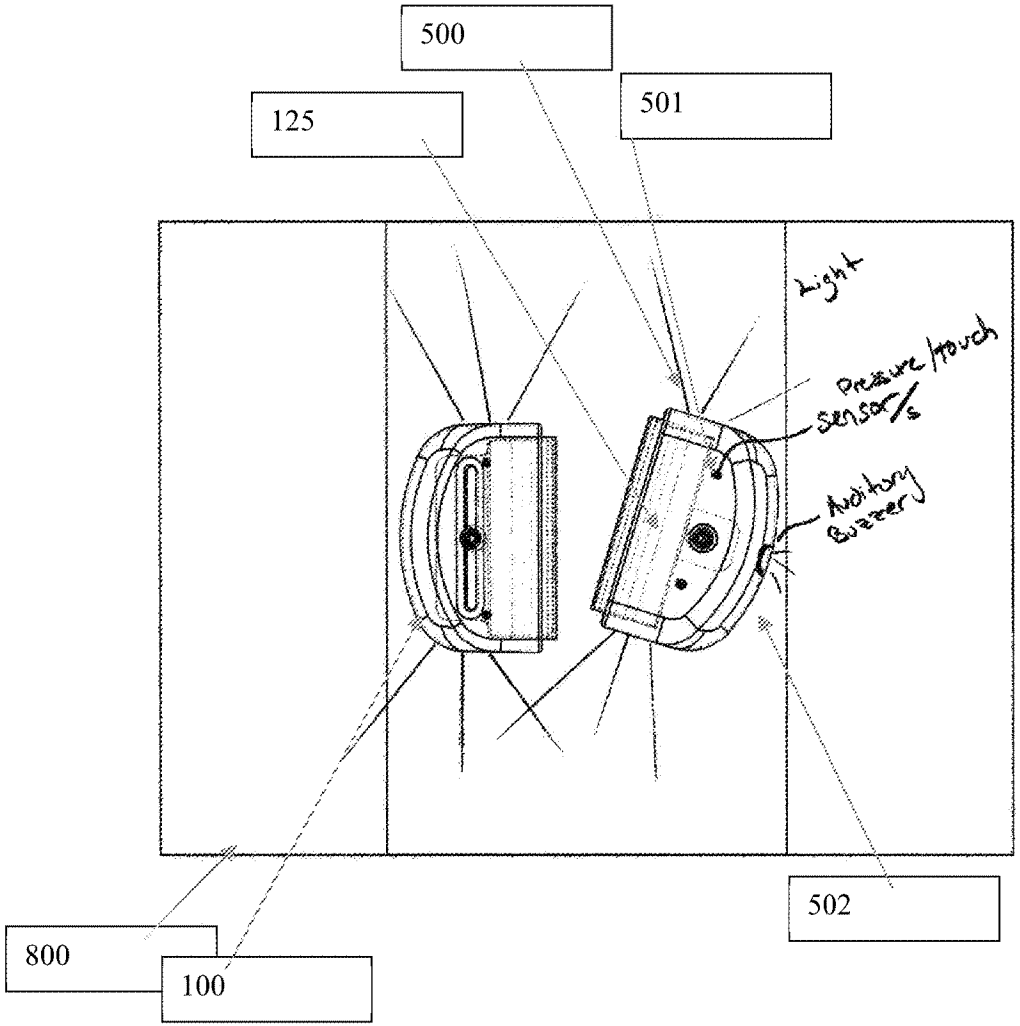
FIG. 56 shows the Light (500), Pressure/Touch Sensors (501), and Auditory Buzzer (502). (Battery Location conferred from the body)

In reference to FIG. 56, locations for a Light, Sensor, and Buzzer are noted. The Light can light up the Translucent body of an I-TCCH or emit from an Opaque body of the I-TCCH, while the Sensor can appear as an individual sensor or as multiple sensors. Likewise, the Buzzer can have a range of auditory tones and frequencies to alert that a position in the climb has been reached.

Figure 57:
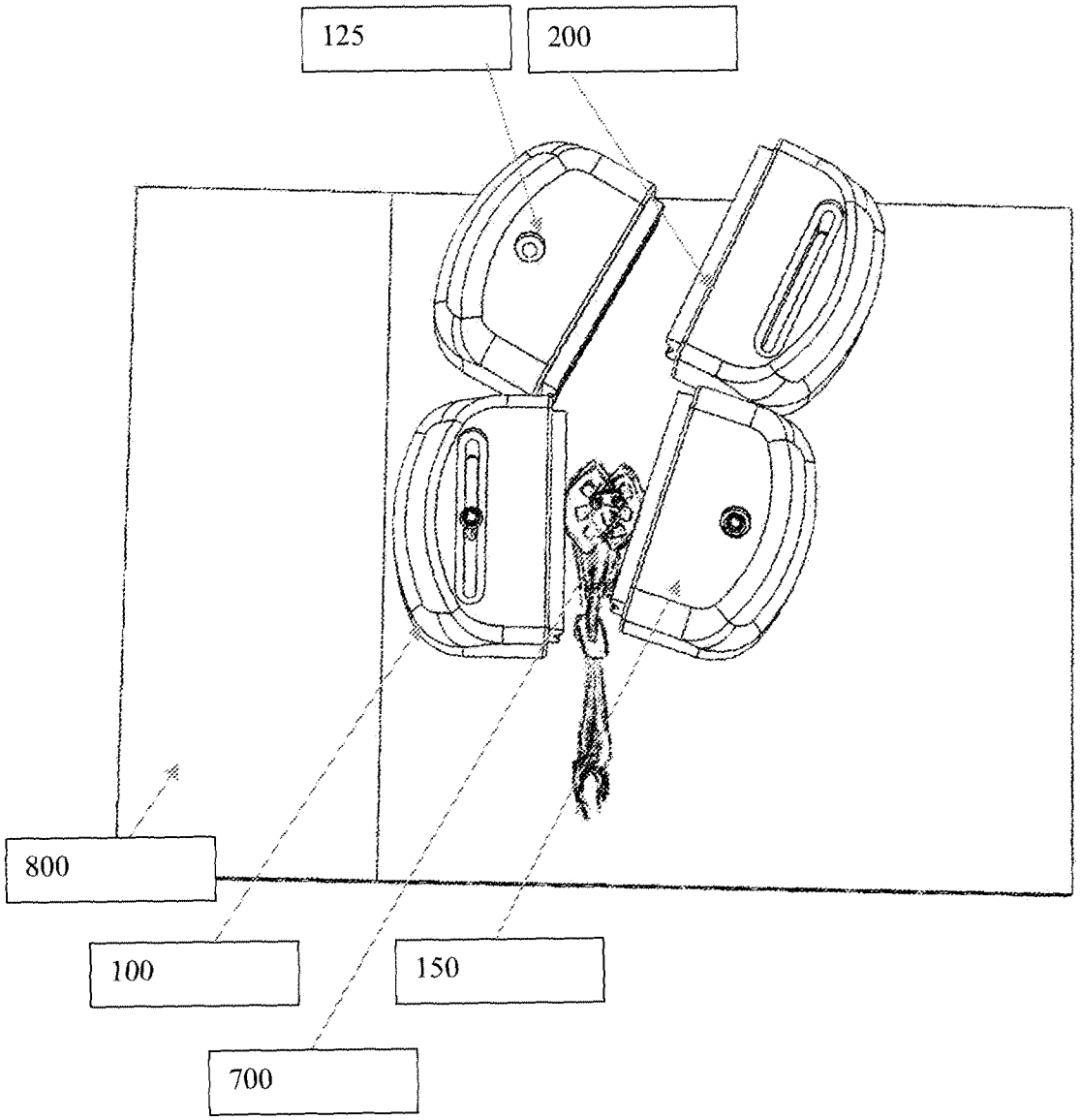
FIG. 57 shows a Cam (700) (traditional climbing gear) anchored into the climbing set.

FIG. 57 expounds upon the conclusion that the when the I-TCCH (150) embodiment is used in combination with any other embodiment, and itself mounted to a Structural Member of the Climbing Wall or to a Sandwich Plate mounted to a Structural Member of the Climbing Wall or to the Connecting Plate between multiple I-TCCH embodiments Traditional Gear can be placed and loaded during a fall arrest with the necessary strength to properly arrest the fall. Thus, is shown a traditional piece of climbing gear; namely a Cam (700) in such a position that would make it capable of arresting a fall.

Figure 58:
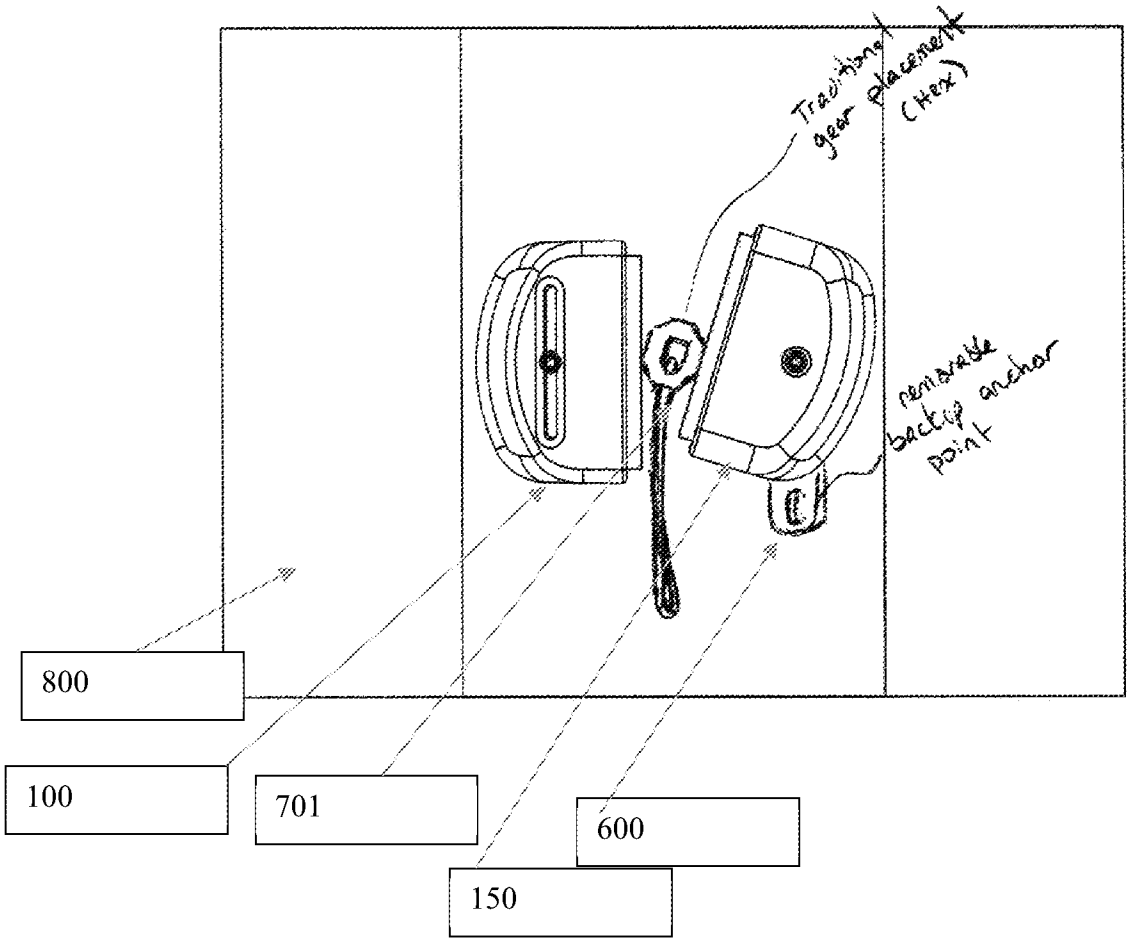
FIG. 58 shows a Hex (701) (traditional climbing gear) anchored into the climbing set as well as a removable backup Anchor (600)

In relation to FIG. 57 is FIG. 58 showing a Wedge/Hex/Nut placement between to I-TCCH Bodies one of which being the embodiment (150), in combination with a removable, and adjustable Anchor. The Anchor (600) being connected through the Climbing Wall Surface to a Structural Member of the Climbing Wall or a Sandwich Plate as noted previously, and forming a surface behind the I-TCCH Body which is "sandwiched" to the Climbing Wall Surface in addition to the common Bolt Connection.

Figure 59:
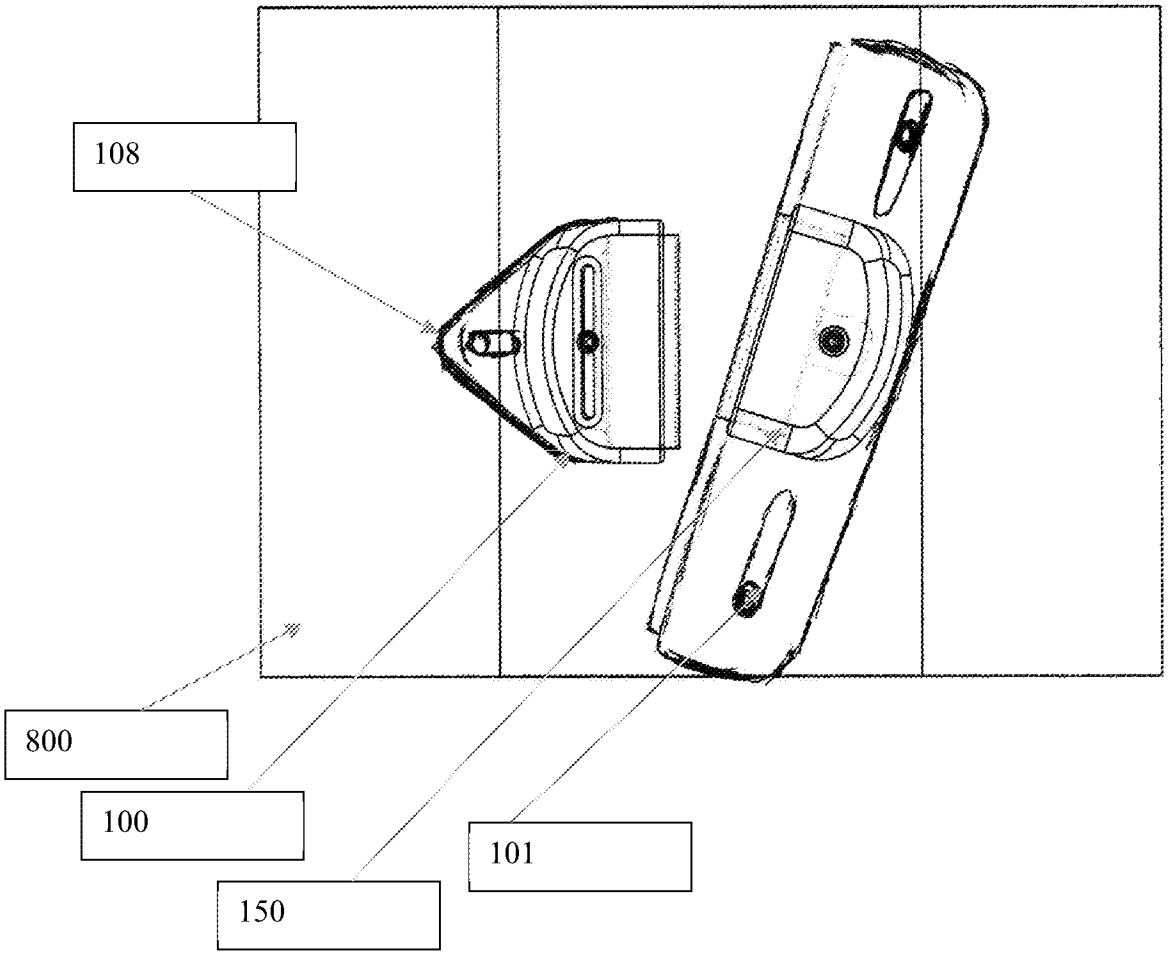
FIG. 59 shows general shape and length changes of the bodies (100, 125, 150) as well as multiple Slots (101) and directional changes of the Slot (101) feature and introduces Additional Mounting Points (108) on any of the various I-TCCH Bodies.

FIG. 59 demonstrates few of the many shape changes and configurations the I-TCCH Body can take on in relation to its more specific features, such that it is not restrained by a rectangular or oval shape in manufacturing in such a way as to create interest in a multi-form body. Also depicted here: length is not a restricting feature. Multiple Slots can be added to a longer I-TCCH Body, as well as a longer Stone, a longer Anchor, and a longer Shape Conforming Body.

Figure 60:
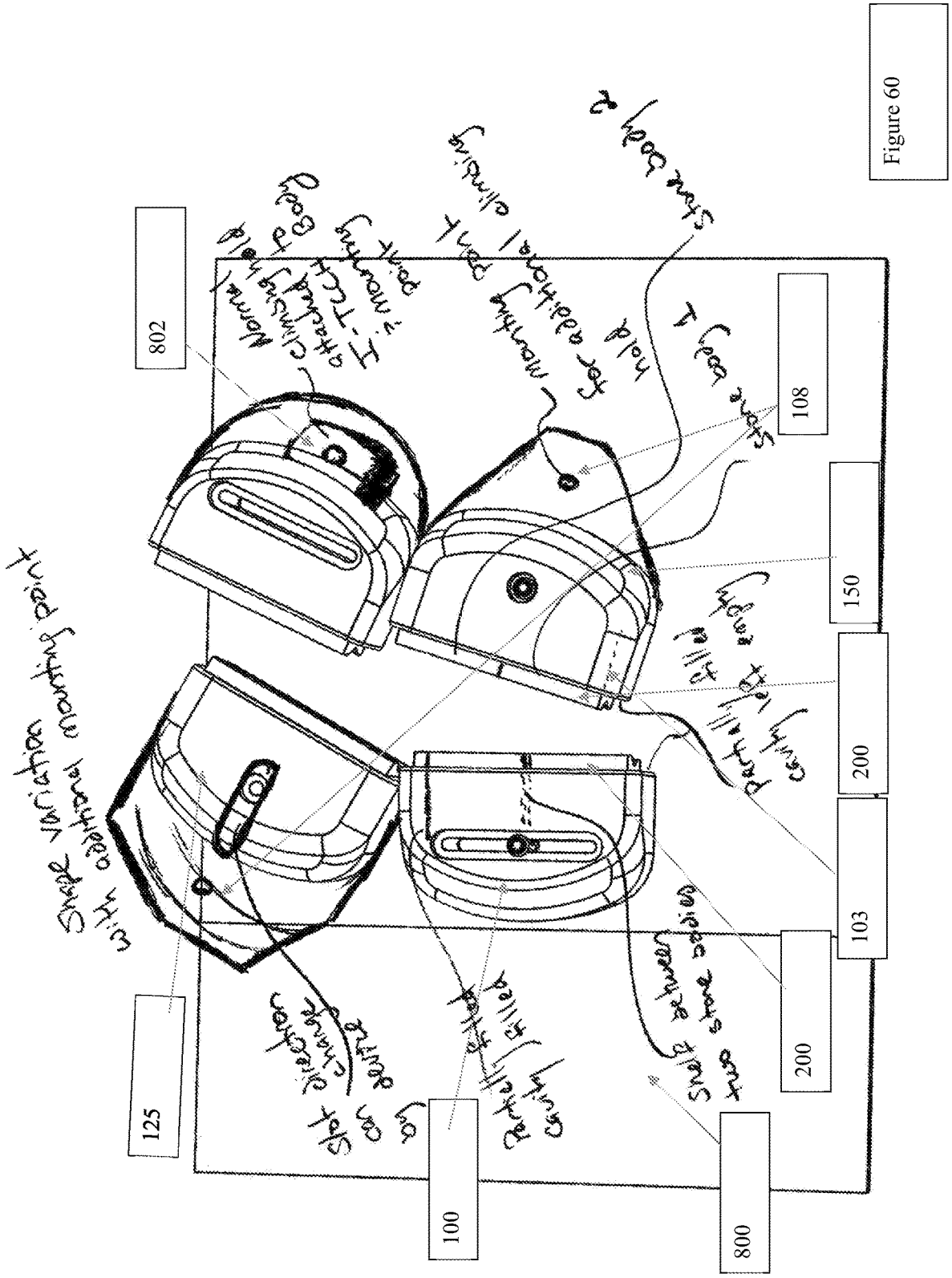
FIG. 60 shows shape variations of the I-TCCH Bodies (100, 125, 150) as well as additional Mounting Points (108) for existing climbing holds upon the I-TCCH Bodies (100, 125, 150). It also shows the partially filled Stone Cavity (103) retaining multiple stones (200) within a single I-TCCH Body (100), and "Normal" climbing hold (802) attached to the I-TCCH Body (100) and conferred upon the variation of I-TCCH Bodies (100, 125, 150).

FIG. 60 puts this into greater detail by showing several shape variations, Slotting arrangements, as well as the I-TCCH feature that permits a standard climbing hold to be attached to the I-TCCH Body. Also, to note in FIG. 60 is the insertion of multiple Stones rather than an individual Stone within the Stone Cavity. In some cases, a "shelf or spacer" can inserted between the stones to reduce impact forces, ease interchangeability, and to remove play from the system in the direction perpendicular to stone insertion.

It stands to note that one skilled in the art of climbing or engineering will recognize that the surface shape of the stone; which will be the surface engaged by the climber whether with appendages or gear, can vary to create new and unique features, while the compressed shape of the stone can vary to be compressed in various configurations.

Similarly, the "Stone" likeness may be actual stone, wood, plastic or a variety of materials capable of simulating rock features or climbing structures. The stone can completely fill the Housing Body or partially fill the Housing Body. The additional space in a partially filled Housing can be left empty or filled with another body to capture or remove the space.

Used individually two or more Stone Bodies can be fit into a single Stone Cavity with or without filling the Cavity and still achieve the crack or crevice like feature that two bodies can otherwise create. This single body can then be used as two separate bodies would be used for gear placements, as a natural hand/foot holds, as a natural anchor, etc. . . .

When used in combination with Sandwich Plates or when bolted to the existing structural frame of the climbing wall, the I-TCCH pair can receive Traditional climbing gear and be loaded as in outdoor traditional climbing as a method of training for traditional climbing indoors.

Traditional Climbing Gear to include Cams, Nuts, Hexes, Tri-Cams, Wedges, Friends, Knots, Aid and other gear will all be able to find a home between this crevice/crack feature.

To further expound on the Anchor as described earlier; it is an attachment and an additional feature can be added to the I-TCCH to create a location for a Sport Anchor and or a Secondary Anchoring Point to act as the Primary Anchoring Point that could be achieved through the placement of Traditional Climbing Gear between the surfaces of the I-TCCH embodiments in a gym setting such that the Traditional Gear is not taking the initial load (Anchor being the higher point in relation to the Traditional Gear) of a fall or such that the Traditional Gear is taking the initial load of a fall (Anchor being the lower Point in relation to the Traditional Gear) and the Anchoring point is acting as a backup to the Traditional Gear placement (Anchor being equal to or slightly offset from the Traditional Gear Placement).

The shape and length the I-TCCH can vary to increase the climbable surface area, as well as the gear placement surface area. In many cases the device can be configured to receive other climbing holds so as not to manipulate too many t-nuts in the creation of a crack feature.

Additionally, as the shape lengthens, the stone inserts can be configured to be a single piece or multiple pieces resting upon one another or upon a surface or surfaces within the I-TCCH Body. To which point the I-TCCH Body in its various forms can as a shape, change direction from that of a linear form to that of a zig-zag form, circular, or other form. What remains significant about the I-TCCH Body is its ability to capture a stone or stone like body and retain it against another surface or multiple surfaces, such that it is retained to the climbing wall surface as a climbing, crack, or traditional gear feature.

Similarly, the direction and number of Slotted Attachment Features on each I-TCCH Body can change from Vertical to Horizontal, Diagonal, or even to an "X" like shape in an effort to capture the available T-Nuts.

Embodiments of the disclosure provide a device to be used individually or in combination with its pair, or with a plurality of similar devices and attachments to be attached to indoor climbing structures in such a way as to simulate an outdoor climbing environment while maintaining an indoor climbing look and feel.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited to the above described embodiment, method, and examples, but by all embodiments and methods within the scope and spirit of the invention.

Drawings Legend

I-TCCH Body (with Slot) 100
- Slot 101
- Tab 102
- Stone Cavity 103
- Through Bolt Hole 105
- Additional Mounting Point 108

I-TCCH Body (with Hole) 125
- Structural Plate Cavity 151
- Rear Cavity 153

I-TCCH Body (with Structural Plate 602 and either slot or hole) 150

Stone 200

Shape Conforming Body 300

Hardware 400
- Bolt 400
- T-nut 401
- Washer 402
- Nut 403

Light/Sound 500
- Light 500
- Sensor 501
- Buzzer 502
- Battery 503

Add On's 600
- Anchoring Body 600
- Sandwich Plate 601

Structural Plate 602
Linking Plate 603
Gear 700
Cam 700
Hex 701
Climbing Wall 800
Climbing Hold 802
Crack Climbing Feature 801

The invention claimed is:

1. An indoor rock crevice simulating hold, comprising:

a housing having a cavity, wherein the housing comprises an opening on opposing walls configured for insertion of a bolt to compress the walls and attach the housing to a surface;

a structural plate inserted into the cavity and having an opening aligned with the opening of the opposing walls of the housing; and a body at least partially inserted into the cavity between opposing walls of the housing, wherein a surface of the body extends from the cavity.

2. The hold of claim 1, further comprising a sensor configured to transmit a signal when the hold has been touched.

3. The hold of claim 2, wherein the signal comprises an auditory and/or visual alert.

4. The hold of claim 1, wherein the housing is formed as a single piece.

5. The hold of claim 1, wherein the housing is formed as multiple pieces.

6. The hold of claim 1, wherein the housing comprises two or more bodies at least partially inserted into the cavity.

7. The hold of claim 1, wherein the body is held between the walls of the housing via a compression or suction force.

8. The hold of claim 1, wherein an external surface of the housing comprises a climbing hold.

9. The hold of claim 1, wherein an external surface of the housing comprises an interlocking feature configured for attachment to another indoor-traditional crack climbing hold.

10. The hold of claim 1, wherein an external surface of the housing comprises an interlocking feature configured for attachment to another indoor rock crevice simulating hold.

11. The hold of claim 1, wherein an external surface of the housing comprises an interlocking feature configured for attachment to a safety/backup anchor.

12. The hold of claim 1, further comprising a plate arranged along a surface of the hold, wherein the plate has a plurality of slots and/or holes configured for mechanical attachment to the hold.

13. A climbing wall comprising two or more holds according to claim 1.

14. The wall of claim 13, further comprising a plate arranged on the wall having a plurality of slots and/or holes configured for mechanical attachment to the two or more holds.

15. The wall of claim 14, wherein the plate is arranged on a surface of the wall opposite the surface of the wall adjacent to the two or more holds.

16. The wall of claim 13, wherein at least two of the holds are arranged on the wall such that the body surface extending from the cavity of one hold is facing the corresponding body surface on a second hold.

17. The wall of claim 13, wherein at least two of the holds are arranged adjacently on the wall and attached via an interlocking feature on the housing of each hold.

18. An indoor rock crevice simulating hold, comprising:

a housing having two or more cavities, wherein the housing comprises an opening on opposing walls configured for insertion of a bolt to compress the walls and attach the housing to a surface;

a structural plate inserted into at least one of the two or more cavities and having an opening aligned with the opening of the opposing walls of the housing; and a body at least partially inserted into a first cavity between opposing walls of the housing, wherein a surface of the body extends from the first cavity.

19. The hold of claim 18, wherein the hold creates a loadable structure when bolted to the surface.

20. An indoor rock crevice simulating hold, comprising:

a housing having two or more cavities, wherein the housing comprises an opening on opposing walls configured for insertion of a bolt to compress the walls and attach the housing to a surface;

a structural plate inserted into at least one of the two or more cavities and having an opening aligned with the opening of the opposing walls of the housing;

a first body at least partially inserted into a first cavity; and a second body at least partially inserted into a second cavity between opposing walls of the housing, wherein a surface of the second body extends from the second cavity.

* * * * *